US009068297B2

(12) United States Patent
Hensley et al.

(10) Patent No.: US 9,068,297 B2
(45) Date of Patent: Jun. 30, 2015

(54) EXPANSION JOINT SYSTEM

(71) Applicant: Emseal Joint Systems Ltd., Westborough, MA (US)

(72) Inventors: Lester Hensley, Westborough, MA (US); William Witherspoon, Guelph (CA)

(73) Assignee: EMSEAL JOINT SYSTEMS LTD., Westborough, MA (US)

( * ) Notice: Subject to any disclaimer, the term of this patent is extended or adjusted under 35 U.S.C. 154(b) by 0 days.

(21) Appl. No.: 14/080,960

(22) Filed: Nov. 15, 2013

(65) Prior Publication Data

US 2014/0219719 A1 Aug. 7, 2014

Related U.S. Application Data

(60) Provisional application No. 61/727,351, filed on Nov. 16, 2012.

(51) Int. Cl.

| | |
|---|---|
| ***E01C 11/02*** | (2006.01) |
| ***E01C 11/14*** | (2006.01) |
| ***E01C 11/10*** | (2006.01) |
| ***E04B 1/68*** | (2006.01) |

(52) U.S. Cl.

CPC ..... *E01C 11/14* (2013.01); *E01C 11/02* (2013.01); *E01C 11/106* (2013.01); *E04B 1/68* (2013.01)

(58) Field of Classification Search

CPC ..... E01C 11/02
USPC ..... 404/47–49, 57, 64, 69; 52/393
See application file for complete search history.

(56) References Cited

U.S. PATENT DOCUMENTS

| | | | |
|---|---|---|---|
| 517,701 | A | 4/1894 | Knower |
| 1,357,713 | A | 11/1920 | Lane |
| 1,428,881 | A | 9/1922 | Dyar |
| 1,691,402 | A | 11/1928 | Oden |
| 1,716,994 | A | 6/1929 | Wehrle |
| 1,809,613 | A | 6/1931 | Walker |
| 2,010,569 | A | 8/1935 | Sitzler |
| 2,152,189 | A | 4/1936 | Henderson |
| 2,190,532 | A | 2/1940 | Lukomski |

(Continued)

FOREIGN PATENT DOCUMENTS

| | | |
|---|---|---|
| CA | 1280007 | 4/1989 |
| CA | 1334268 | 8/1989 |

(Continued)

OTHER PUBLICATIONS

"Polyurethane Foam Field Joint Infill Systems", Sep. 23, 2007 (via Snagit), PIH, pp. 1-4.

(Continued)

*Primary Examiner* — Raymond W Addie
(74) *Attorney, Agent, or Firm* — MKG LLC

(57) ABSTRACT

An expansion joint system includes: a core; and a layer of an elastomer disposed on the core. The core and the layer of elastomer disposed thereon form an elongated section, the elongated section configured to be oriented vertically between substantially coplanar substrates. The expansion joint system further includes a termination section located at one end of the elongated section and comprising a flared end forming an angle with the elongated section and configured to direct fluid and/or particles and/or solvents away from the expansion joint system.

39 Claims, 4 Drawing Sheets

(56) References Cited

U.S. PATENT DOCUMENTS 2,240,787 A * 5/1941 Kinzer ..... 404/47
2,271,180 A 1/1942 Brugger
2,277,286 A 3/1943 Bechtner
2,701,155 A 2/1955 Estel, Jr.
2,776,865 A 1/1957 Anderson
2,828,235 A 3/1958 Holland et al.
2,954,592 A 10/1960 Parsons
3,024,504 A 3/1962 Miller
3,111,069 A 11/1963 Farbish
3,124,047 A 3/1964 Graham
3,172,237 A 3/1965 Bradley
3,232,786 A 2/1966 Kellman
3,244,130 A 4/1966 Hippie, Jr.
3,289,374 A 12/1966 Metz
3,298,653 A 1/1967 Omholt
3,300,913 A 1/1967 Patry et al.
3,302,690 A 2/1967 Hurd
3,344,011 A 9/1967 Goozner
3,355,846 A 12/1967 Tillson
3,363,383 A 1/1968 Barge
3,371,456 A 3/1968 Balzer et al.
3,372,521 A 3/1968 Thom
3,378,958 A 4/1968 Parks et al.
3,394,639 A 7/1968 Viehmann
3,410,037 A 11/1968 Empson et al.
3,435,574 A 4/1969 Hallock
3,447,430 A 6/1969 Gausepohl
3,470,662 A 10/1969 Kellman
3,482,492 A 12/1969 Bowman
3,543,459 A 12/1970 Mills
3,551,009 A 12/1970 Cammuso et al.
3,575,372 A 4/1971 Emberson
3,582,095 A 6/1971 Bogaert et al.
3,603,048 A 9/1971 Hadfield
3,606,826 A 9/1971 Bowman
3,629,986 A 12/1971 Klittich
3,643,388 A 2/1972 Parr et al.
3,659,390 A 5/1972 Balzer et al.
3,670,470 A 6/1972 Thom
3,672,707 A 6/1972 Russo et al.
3,677,145 A 7/1972 Wattiez
3,694,976 A 10/1972 Warshaw
3,720,142 A 3/1973 Pare
3,736,713 A 6/1973 Flachbarth et al.
3,742,669 A 7/1973 Mansfeld
3,750,359 A 8/1973 Balzer et al.
3,797,188 A 3/1974 Mansfeld
3,849,958 A 11/1974 Balzer et al.
3,880,539 A 4/1975 Brown
3,896,511 A 7/1975 Cuschera
3,911,635 A 10/1975 Traupe
3,934,905 A 1/1976 Lockard
3,944,704 A 3/1976 Dirks
3,951,562 A 4/1976 Fyfe
3,956,557 A 5/1976 Hurst
3,974,609 A 8/1976 Attaway
4,007,994 A 2/1977 Brown
4,018,017 A 4/1977 Schoop
4,022,538 A 5/1977 Watson et al.
4,055,925 A 11/1977 Wasserman et al.
4,058,947 A 11/1977 Earle et al.
4,129,967 A 12/1978 Barlow
4,140,419 A 2/1979 Puccio
4,146,939 A 4/1979 Izzi
4,174,420 A 11/1979 Anolick et al.
4,204,856 A 5/1980 Yigdall et al.
4,221,502 A 9/1980 Tanikawa
4,224,374 A 9/1980 Priest
4,245,925 A 1/1981 Pyle
4,246,313 A 1/1981 Stengle, Jr.
4,258,606 A 3/1981 Wilson
4,270,318 A 6/1981 Carroll et al.
4,271,650 A 6/1981 Lynn-Jones
4,290,249 A 9/1981 Mass
4,290,713 A 9/1981 Brown et al.
4,295,311 A 10/1981 Dahlberg
4,305,680 A 12/1981 Rauchfuss, Jr.
4,359,847 A 11/1982 Schukolinski
4,362,428 A 12/1982 Kerschner
4,367,976 A 1/1983 Bowman
4,374,442 A 2/1983 Hein et al.
4,401,716 A 8/1983 Tschudin-Mahrer
4,424,956 A 1/1984 Grant et al.
4,431,691 A 2/1984 Greenlee
4,432,465 A 2/1984 Wuertz
4,433,732 A 2/1984 Licht et al.
4,447,172 A 5/1984 Galbreath
4,453,360 A 6/1984 Barenberg
4,455,396 A 6/1984 Al-Tabaqchall et al.
4,473,015 A 9/1984 Hounsel
4,486,994 A 12/1984 Fisher et al.
4,494,762 A 1/1985 Geipel
4,533,278 A 8/1985 Corsover et al.
4,558,875 A 12/1985 Yamaji et al.
4,564,550 A 1/1986 Tschudin-Mahrer
4,566,242 A 1/1986 Dunsworth
4,576,841 A 3/1986 Lingemann
4,589,242 A 5/1986 Moulinie et al.
4,615,411 A 10/1986 Breitscheidel et al.
4,620,330 A 11/1986 Izzi, Sr.
4,620,407 A 11/1986 Schmid
4,622,251 A 11/1986 Gibb
4,637,085 A 1/1987 Hartkorn
4,693,652 A 9/1987 Sweeney
4,717,050 A 1/1988 Wright
4,745,711 A 5/1988 Box
4,751,024 A 6/1988 Shu et al.
4,756,945 A 7/1988 Gibb
4,767,655 A 8/1988 Tschudin-Mahrer
4,773,791 A 9/1988 Hartkorn
4,780,571 A 10/1988 Huang
4,781,003 A 11/1988 Rizza
4,791,773 A 12/1988 Taylor
4,807,843 A 2/1989 Courtois et al.
4,815,247 A 3/1989 Nicholas
4,824,283 A 4/1989 Belangie
4,835,130 A 5/1989 Box
4,839,223 A 6/1989 Tschudin-Mahrer
4,848,044 A 7/1989 LaRoche et al.
4,849,223 A 7/1989 Pratt et al.
4,866,898 A 9/1989 LaRoche et al.
4,879,771 A 11/1989 Piskula
4,882,890 A 11/1989 Rizza
4,885,885 A 12/1989 Gottschling
4,893,448 A 1/1990 McCormick
4,901,488 A 2/1990 Murota et al.
4,916,878 A 4/1990 Nicholas
4,920,725 A 5/1990 Gore
4,927,291 A 5/1990 Belangie
4,932,183 A 6/1990 Coulston
4,942,710 A 7/1990 Rumsey
4,952,615 A 8/1990 Welna
4,957,798 A 9/1990 Bogdany
4,965,976 A 10/1990 Riddle et al.
4,977,018 A 12/1990 Irrgeher et al.
4,992,481 A 2/1991 von Bonin et al.
5,007,765 A 4/1991 Dietlein et al.
5,013,377 A 5/1991 Lafond
5,026,609 A 6/1991 Jacob et al.
5,035,097 A 7/1991 Cornwall
5,060,439 A 10/1991 Clements et al.
5,071,282 A 12/1991 Brown
5,072,557 A 12/1991 Naka et al.
5,082,394 A 1/1992 George
5,094,057 A 3/1992 Morris
5,115,603 A 5/1992 Blair
5,120,584 A 6/1992 Ohlenforst et al.
5,121,579 A 6/1992 Hamar et al.
5,130,176 A 7/1992 Baerveldt
5,137,937 A 8/1992 Huggard et al.
5,168,683 A 12/1992 Sansom et al.
5,173,515 A 12/1992 von Bonin et al.
5,190,395 A 3/1993 Cathey et al.
5,209,034 A 5/1993 Box et al.

(56) References Cited

U.S. PATENT DOCUMENTS

| | | | |
|---|---|---|---|
| 5,213,441 | A | 5/1993 | Baerveldt |
| 5,222,339 | A | 6/1993 | Hendrickson et al. |
| 5,249,404 | A | 10/1993 | Leek et al. |
| 5,270,091 | A | 12/1993 | Krysiak et al. |
| 5,297,372 | A | 3/1994 | Nicholas |
| 5,327,693 | A | 7/1994 | Schmid |
| 5,335,466 | A | 8/1994 | Langohr |
| 5,338,130 | A | 8/1994 | Baerveldt |
| 5,354,072 | A | 10/1994 | Nicholson |
| 5,365,713 | A | 11/1994 | Nicholas et al. |
| 5,367,850 | A | 11/1994 | Nicholas |
| 5,380,116 | A | 1/1995 | Colonias |
| 5,436,040 | A | 7/1995 | Lafond |
| 5,441,779 | A | 8/1995 | Lafond |
| 5,443,871 | A | 8/1995 | Lafond |
| 5,450,806 | A | 9/1995 | Jean |
| 5,456,050 | A | 10/1995 | Ward |
| 5,472,558 | A | 12/1995 | Lafond |
| 5,479,745 | A | 1/1996 | Kawai et al. |
| 5,485,710 | A | 1/1996 | Lafond |
| 5,489,164 | A | 2/1996 | Tusch et al. |
| 5,491,953 | A | 2/1996 | Lafond |
| 5,498,451 | A | 3/1996 | Lafond |
| 5,501,045 | A | 3/1996 | Wexler |
| 5,508,321 | A | 4/1996 | Brebner |
| 5,528,867 | A | 6/1996 | Thompson |
| RE35,291 | E | 7/1996 | Lafond |
| 5,572,920 | A | 11/1996 | Kennedy et al. |
| 5,607,253 | A | 3/1997 | Almstrom |
| 5,611,181 | A | 3/1997 | Shreiner et al. |
| 5,616,415 | A | 4/1997 | Lafond |
| 5,628,857 | A | 5/1997 | Baerveldt |
| 5,635,019 | A | 6/1997 | Lafond |
| 5,649,784 | A | 7/1997 | Ricaud et al. |
| 5,650,029 | A | 7/1997 | Lafond |
| 5,656,358 | A | 8/1997 | Lafond |
| 5,658,645 | A | 8/1997 | Lafond |
| 5,664,906 | A | 9/1997 | Baker et al. |
| 5,691,045 | A | 11/1997 | Lafond |
| 5,744,199 | A | 4/1998 | Joffre et al. |
| 5,759,665 | A | 6/1998 | Lafond |
| 5,762,738 | A | 6/1998 | Lafond |
| 5,765,332 | A | 6/1998 | Landin et al. |
| 5,773,135 | A | 6/1998 | Lafond |
| 5,791,111 | A | 8/1998 | Beenders |
| 5,806,272 | A | 9/1998 | Lafond |
| 5,813,191 | A | 9/1998 | Gallagher |
| 5,830,319 | A | 11/1998 | Landin |
| 5,851,609 | A | 12/1998 | Baratuci et al. |
| 5,875,598 | A | 3/1999 | Batten et al. |
| 5,876,554 | A | 3/1999 | Lafond |
| 5,878,448 | A | 3/1999 | Molter |
| 5,887,400 | A | 3/1999 | Bratek et al. |
| 5,888,341 | A | 3/1999 | Lafond |
| 5,935,695 | A | 8/1999 | Baerveldt |
| 5,957,619 | A | 9/1999 | Kinoshita et al. |
| 5,974,750 | A | 11/1999 | Landin et al. |
| 5,975,181 | A | 11/1999 | Lafond |
| 6,001,453 | A | 12/1999 | Lafond |
| 6,014,848 | A | 1/2000 | Hilburn, Jr. |
| 6,035,602 | A | 3/2000 | Lafond |
| 6,039,503 | A | 3/2000 | Cathey |
| D422,884 | S | 4/2000 | Lafond |
| 6,088,972 | A | 7/2000 | Johanneck |
| 6,102,407 | A | 8/2000 | Moriya et al. |
| 6,115,980 | A | 9/2000 | Knak et al. |
| 6,115,989 | A | 9/2000 | Boone et al. |
| 6,128,874 | A | 10/2000 | Olson et al. |
| 6,131,352 | A | 10/2000 | Barnes et al. |
| 6,131,364 | A | 10/2000 | Peterson |
| 6,131,368 | A | 10/2000 | Tramposch et al. |
| 6,138,427 | A | 10/2000 | Houghton |
| 6,148,890 | A | 11/2000 | Lafond |
| 6,158,915 | A | 12/2000 | Kise |
| 6,189,573 | B1 | 2/2001 | Ziehm |
| 6,192,652 | B1 | 2/2001 | Goer et al. |
| 6,207,085 | B1 | 3/2001 | Ackerman |
| 6,207,089 | B1 | 3/2001 | Chuang |
| 6,250,358 | B1 | 6/2001 | Lafond |
| 6,253,514 | B1 | 7/2001 | Jobe et al. |
| 6,329,030 | B1 | 12/2001 | Lafond |
| 6,350,373 | B1 | 2/2002 | Sondrup |
| 6,351,923 | B1 | 3/2002 | Peterson |
| 6,355,328 | B1 | 3/2002 | Baratuci et al. |
| 6,368,670 | B1 | 4/2002 | Frost et al. |
| 6,419,237 | B1 | 7/2002 | More |
| 6,439,817 | B1 | 8/2002 | Reed |
| 6,443,495 | B1 | 9/2002 | Harmeling |
| 6,460,214 | B1 | 10/2002 | Chang |
| 6,491,468 | B1 | 12/2002 | Hagen |
| 6,499,265 | B2 | 12/2002 | Shreiner |
| 6,532,708 | B1 | 3/2003 | Baerveldt |
| 6,544,445 | B1 | 4/2003 | Graf et al. |
| 6,574,930 | B2 | 6/2003 | Kiser |
| 6,581,341 | B1 | 6/2003 | Baratuci et al. |
| 6,665,995 | B2 | 12/2003 | Deane |
| 6,666,618 | B1 | 12/2003 | Anaya et al. |
| 6,685,196 | B1 | 2/2004 | Baerveldt |
| 6,820,382 | B1 | 11/2004 | Chambers et al. |
| 6,860,074 | B2 | 3/2005 | Stanchfield |
| 6,862,863 | B2 | 3/2005 | McCorkle et al. |
| 6,877,292 | B2 | 4/2005 | Baratuci et al. |
| 6,897,169 | B2 | 5/2005 | Matsui et al. |
| 6,905,650 | B2 | 6/2005 | McIntosh et al. |
| 6,948,287 | B2 | 9/2005 | Korn |
| 6,989,188 | B2 | 1/2006 | Brunnhofer et al. |
| 6,996,944 | B2 | 2/2006 | Shaw |
| 7,043,880 | B2 | 5/2006 | Morgan et al. |
| 7,070,653 | B2 | 7/2006 | Frost et al. |
| 7,090,224 | B2 | 8/2006 | Iguchi et al. |
| 7,114,899 | B2 | 10/2006 | Gass et al. |
| 7,210,557 | B2 | 5/2007 | Phillips et al. |
| 7,222,460 | B2 | 5/2007 | Francies, III et al. |
| 7,225,824 | B2 | 6/2007 | West et al. |
| 7,240,905 | B1 | 7/2007 | Stahl, Sr. |
| 7,278,450 | B1 | 10/2007 | Condon |
| 7,287,738 | B2 | 10/2007 | Pitlor |
| 7,441,375 | B2 | 10/2008 | Lang |
| 7,621,731 | B2 | 11/2009 | Armantrout et al. |
| 7,665,272 | B2 | 2/2010 | Reen |
| 7,678,453 | B2 | 3/2010 | Ohnstad et al. |
| 7,748,310 | B2 | 7/2010 | Kennedy |
| 7,757,450 | B2 | 7/2010 | Reyes et al. |
| 7,836,659 | B1 | 11/2010 | Barnes |
| 7,856,781 | B2 | 12/2010 | Hilburn, Jr. |
| 7,877,958 | B2 | 2/2011 | Baratuci et al. |
| 7,941,981 | B2 | 5/2011 | Shaw |
| 8,033,073 | B1 | 10/2011 | Binder |
| 8,079,190 | B2 | 12/2011 | Hilburn, Jr. |
| 8,171,590 | B2 | 5/2012 | Kim |
| 8,172,938 | B2 | 5/2012 | Alright et al. |
| 8,317,444 | B1 | 11/2012 | Hensley |
| 8,333,532 | B2 | 12/2012 | Derrigan et al. |
| 8,341,908 | B1 | 1/2013 | Hensley et al. |
| 8,365,495 | B1 | 2/2013 | Witherspoon |
| 8,601,760 | B2 | 12/2013 | Hilburn, Jr. |
| 8,720,138 | B2 | 5/2014 | Hilburn, Jr. |
| 8,739,495 | B1 | 6/2014 | Witherspoon |
| 8,813,449 | B1 | 8/2014 | Hensley et al. |
| 8,813,450 | B1 | 8/2014 | Hensley et al. |
| 2002/0088192 | A1 | 7/2002 | Calixto |
| 2002/0095908 | A1 | 7/2002 | Kiser |
| 2002/0113143 | A1 | 8/2002 | Frost et al. |
| 2002/0193552 | A1 | 12/2002 | Kiuchi et al. |
| 2003/0110723 | A1 | 6/2003 | Baerveldt |
| 2003/0213211 | A1 | 11/2003 | Morgan et al. |
| 2004/0020162 | A1 | 2/2004 | Baratuci et al. |
| 2004/0045234 | A1 | 3/2004 | Morgan et al. |
| 2004/0101672 | A1 | 5/2004 | Anton et al. |
| 2004/0113390 | A1 | 6/2004 | Broussard, III |
| 2005/0066600 | A1 | 3/2005 | Moulton et al. |
| 2005/0120660 | A1 | 6/2005 | Kim et al. |
| 2005/0155305 | A1 | 7/2005 | Cosenza et al. |
| 2005/0193660 | A1 | 9/2005 | Mead |

(56) References Cited

U.S. PATENT DOCUMENTS

| | | | |
|---|---|---|---|
| 2005/0222285 | A1 | 10/2005 | Massengill et al. |
| 2006/0010817 | A1 | 1/2006 | Shull |
| 2006/0030227 | A1 | 2/2006 | Hairston et al. |
| 2006/0117692 | A1 | 6/2006 | Trout |
| 2007/0059516 | A1 | 3/2007 | Vincent et al. |
| 2007/0137135 | A1 | 6/2007 | Shymkowich |
| 2007/0199267 | A1 | 8/2007 | Moor |
| 2007/0261342 | A1 | 11/2007 | Cummings |
| 2008/0172967 | A1 | 7/2008 | Hilburn |
| 2008/0193738 | A1 | 8/2008 | Hensley et al. |
| 2008/0268231 | A1 | 10/2008 | Deib |
| 2009/0036561 | A1 | 2/2009 | Nygren |
| 2009/0223150 | A1 | 9/2009 | Baratuci et al. |
| 2009/0223159 | A1 | 9/2009 | Colon |
| 2009/0246498 | A1 | 10/2009 | Deiss |
| 2009/0315269 | A1 | 12/2009 | Deiss |
| 2010/0058696 | A1 | 3/2010 | Mills |
| 2010/0275539 | A1 | 11/2010 | Shaw |
| 2010/0281807 | A1 | 11/2010 | Bradford |
| 2010/0319287 | A1 | 12/2010 | Shaw |
| 2011/0016808 | A1 | 1/2011 | Hulburn, Jr. |
| 2011/0083383 | A1 | 4/2011 | Hilburn, Jr. |
| 2011/0088342 | A1 | 4/2011 | Stahl, Sr. et al. |
| 2011/0135387 | A1 | 6/2011 | Derrigan et al. |
| 2011/0247281 | A1 | 10/2011 | Pilz et al. |
| 2012/0117900 | A1 | 5/2012 | Shaw |
| 2014/0151968 | A1 | 6/2014 | Hensley et al. |

FOREIGN PATENT DOCUMENTS

| | | | |
|---|---|---|---|
| CA | 1259351 | | 9/1989 |
| CA | 1259351 | A | 9/1989 |
| CA | 1280007 | | 2/1991 |
| CA | 2296779 | C | 11/2006 |
| CA | 2640007 | A1 | 3/2009 |
| DE | 19809973 | C1 | 7/1999 |
| DE | 102005054375 | A1 | 5/2007 |
| DE | 102005054375 | A1 | 5/2007 |
| EP | 0976882 | A2 | 2/1999 |
| EP | 0942107 | A2 | 9/1999 |
| EP | 1118715 | A1 | 7/2001 |
| EP | 1118726 | A1 | 7/2001 |
| EP | 1540220 AO | | 2/2004 |
| EP | 1540220 | B1 | 8/2006 |
| EP | 1983119 | A1 | 4/2007 |
| EP | 1983119 | B1 | 10/2008 |
| GB | 2181093 | A | 4/1987 |
| GB | 2251623 | A1 | 7/1992 |
| GB | 2359265 | A | 8/2001 |
| GB | 2377379 | A | 1/2003 |
| JP | 200645950 | A | 2/2006 |
| WO | 2003006109 | A1 | 1/2003 |
| WO | 2007023118 | A2 | 3/2007 |
| WO | 2007024246 | A1 | 3/2007 |

OTHER PUBLICATIONS

EMSEAL Joint Systems LTD. Drawing Part No. SJS-100-CHT-RN dated Nov. 20, 2007.
EMSEAL Joint Systems LTD. Drawing Part No. 010-0-00-00 dated Dec. 6, 2005.
EMSEAL Material Safety Data Sheet dated Apr. 2002, pp. 1-2.
EMSEAL "Benchmarks of Performance for High-Movement Acrylic-Impregnated, Precompressed, Foam Sealants When Considering Substitutions"; http://www.emseal.com/Knowledge/AcrylicVsWax/AcrylicVsWaxBased.htm; printed on Jul. 3, 2012, pp. 1-4.
EMSEAL Colorseal & Seismic Colorseal Install Data, May 1997, pp. 1-2.
EMSEAL Colorseal Tech Data, Jan. 2000, pp. 1-2.
EMSEAL "Is There a Gap in Your Air Barrier Wall Design?: Overlooking joint sealing where it really matters—in the structural backup wall"; http://www.emseal.com/Knowledge/GapInAirBarrierDesign/GapInAirBarrierDesign.htm; printed on Jul. 19, 2012, pp. 1-2.
Manfredi, Liliana; et al. "Thermal degradation and fire resistance of unsaturated polyester, modified acrylic resins and their composites with natural fibres" Polymer Degradation and Stability 91; 2006; pp. 255-261.
EMSEAL "Pre-cured-Caulk-And-Backerblock Not New, Not Equal to EMSEAL's COLORSEAL"; http://www.emseal.com/Knowledge/PreCuredCaulk/COLORSEALvsPreCuredCaulk.htm; printed on Jul. 19, 2012, pp. 1-3.
EMSEAL Joint Systems, Techdata, Jun. 1997.
Stein, Daryl et al. "Chlorinated Paraffins as Effective Low Cost Flame Retardants for Polyethylene" Dover Chemical Corporation.
Promat International, Ltd., Promaseal Guide for Linear Gap Seals and Fire Stopping Systems, Jun. 2008, pp. 1-20.
Promat International, Ltd., Promaseal IBS Foam Strip, Penetration Seals on Floors/Walls, labeled Copyright 2004, pp. 1-6.
Promat International, Ltd., Safety Data Sheet, Promaseal IBS, May 25, 2007, pp. 1-3.
Schul International, Co., LLC., Color Econoseal, Technical Data, Premium Quality Joint Sealant for Waterproof Vertical and Horizontal Applications, 2005, pp. 1-2.
Shul International, Co., LLC., Sealtite Airstop FR, Air and Sound Infiltration Barrier, labeled Copyright 1997-04, p. 1.
Schul International, Co., LLC., Sealtite Standard, Pre-compressed Joint Sealant, High Density, Polyurethane Foam, Waterproofs Vertical Applications, 2007.
Schul International Co., LLC., Sealtite VP (600) Technical Data, Premium Quality Pre-compressed Joint Sealant for Weather tight, Vapor Permeable, Vertical Applications, labeled Copyright 1997-2002, pp. 1-2.
Schul International Co., LLC., Seismic Sealtite, Technical Data, Colorized, Pre-compressed Joint Sealant for Vertical Applications, 2005, pp. 1-2.
Schul International Co., LLC., Sealtite 50N, Technical Data, Premium Quality Pre-compressed Joint Sealant for Horizontal Applications, labeled Copyright 2002, pp. 1-2.
Schul International Co., LLC., HydroStop, Expansion Joint System, 2005, pp. 1-2.
Schul International Co., LL., Sealtite, The Most Complete Line of Pre-compressed Sealants, web archive.org, wayback machine, printed 2014, pp. 1-3.
Sealant, Waterproofing & Restoration Institute, Sealants: The Professional Guide, labeled Copyright 1995, Chapter II-Sealants, p. 26, pp. 1-3.
Tremco Illbruck, Cocoband 6069, 2007, p. 1 with English translation.
Tremco Illbruck, Alfacryl FR Intumescent Acrylic, Fire Rated, Emulsion Acrylic, Intumescent Sealant, 2007, pp. 1-2.
Tremco Illbruck, Alfasil FR, Fire Rated, Low Modulus, Neutral Cure Silicone Sealant, 2007, pp. 1-2.
Tremco Illbruck, Compriband 600, Impregnated Joint Sealing Tape, 2007, pp. 1-2.
Tremco Illbruck, Compriband Super FR, Fire Rated Acrylic Impregnated Foam Sealant Strip, 2007, pp. 1-2.
Tremco Illbruck, Ltd., Technical Data Sheet, Compriband Super FR, Issue 2, Oct. 18, 10, 2004, pp. 1-4.
Tremco Illbruck, Ltd., Technical Data Sheet, Compriband Super, Issue 1, Sep. 29, 2004, pp. 1-3.
Illbruck, TechSpec Division Facade & Roofing Solutions, Mar. 2005, pp. 1-10.
Tremco Illbruck, Alfas Bond FR, 2007, pp. 1-2.
Tremco Illbruck, Illmod 600, Jun. 2006, pp. 1-2.
Tremco Illbruck, The Specification Product Range, 2007, pp. 1-36.
Ul Online Certifications Directory, System No. WW-S-0007, XHBN. WW-S-0007, Joint Systems, Dec. 5, 1997, pp. 1-3.
Ul Online Certifications Directory, BXUV.Guidelnfo, Fire-Resistance Ratings ANSI/UL 263, last updated Jun. 26, 2014, pp. 1-24.
Frangi et al., German language, Zum Brandverhalten von Holzdecken aus Hohlkasten-elementen, Institut fur Baustatik and Konstrucktion, Jun. 1999, pp. 1-130.
ASTM International, Designation: E 1966-01, Standard Test Method for Fire-Resistive Joint Systems, pp. 1- 15.
www.businesswire.com, Celanese Introduces Mowilith Nano Technology Platform for the Next General of Exterior Coatings, May 8, 2007, Nurnberg, Germany, pp. 1-3.

(56) References Cited

OTHER PUBLICATIONS

Dayton Superior Chemical & Cement Products, Marketing Update, Fall 2005, pp. 1-2.
Dow Corning Silicone Sealants, Dow Corning 790 Silicone Building Sealant, Ultra-low-modulus sealant for new and remedial construction joint sealing applications, labeled Copyright 2000-2005, pp. 1-2.
Dow Corning, John D. Farrell Letter to Emseal USA, Wilford Brewer, reference: Emseal Greyflex, Oct. 4, 1984, p. 1.
Emseal Joint Systems, Ltd., Greyflex & Backerseal Wet Sealant Compatibility Chart, Test Data, Sep. 1991, p. 1.
www.emseal.com/products, Horizontal Colorseal by Emseal Expansion Joints and Pre-Compressed Sealants, last modified Sep. 19, 2014.
Emseal Joint Systems, The complete package for all joint requirements, 1988, pp. 1-6.
web.archive.org, www.envirograf.com, Product 40: Intumescent-Coated Fireproof Sponge (patented), labeled Copyright 2007, pp. 1-2.
web.archive.org, www.envirograf.com, Product 5: Intumescent-Caoted Non-Fibrous Slabs (patented), labeled Copyright Apr. 10, 2007, p. 1.
Hanno Dicht-und Dammsysteme, Hannoband-BG1, High Performance am Bau, German language, 2000, pp. 1-6.
Illbruck Sealant Systems, Cocoband 6069, Productinfomatie, Dutch language, 2003, pp. 1-2.
Illbruck Sealant Systems, Inc., Sealant Products and Systems, 2002, pp. 1-12.
Adolf Wurth GmbH & Co., KG, Elastic Joint Sealing Tape, labeled Copyright 2000-2003, pp. 1-7.
Expanding PU Foam, Technical Data Sheet, Feb. 1997, pp. 1-2.
ASTM International, Designation: E 84-04, Standard Test Method for Surface Burning Characteristics of Building Materials, Feb. 2004, pp. 1-19.
ASTM International, Designation: E 176-07, Standard Terminology of Fire Standards, Oct. 2007, pp. 1-20.
Auburn Manufacturing Company, Auburn Product News, Flame Retardant Silicone Sponge, 2007, p. 1.
British Board of Agrement, Agrement Certificate No. 97/3331, Second Issue, Compriband Super, 2005, pp. 1-4.
British Board of Agrement, Agrement Certificate No. 96/3309, Third Issue, Illmod 600 Sealing Tapes, 2003, pp. 1-8.
Nederland Normalistie-Instituut, Experimental Determination of the Fire Resistance of Elements of Building Construction, NEN 6069, Oct. 1991, English Translation, pp. 1-30.
British Standards Institution, Fire Tests on Building Materials and Structures, BS 476: Part 20: 1987, pp. 1-44.
DIN Deutsches Institut for Normung e.V., DIN 18542, Impregnated Cellular Plastics Strips for Sealing External Joints, Requirements and Testing, Jan. 1999, pp. 1-10.
www.BuildingTalk.com, Emseal Joint Systems, Choosing a Sealant for Building Applications, Hensley. May 21, 2007, pp. 1-6.
Netherlands Organization for Applied Scientific Research (TNO), Determination of the Fire Resistance According to NEN 6069 of Joints in a Wall Sealed with Cocoband 6069 Impregnated Foam Strip, Nov. 1996, pp. 1-19.
DIN Deutsches Institut fur Normung e.V., Fire Behaviour of Building Materials and Elements, Part 1: Classification of Building Materials, Requirements and Testing, DIN 4102-1, May 1998, pp. 1-33.
DIN Deutsches Institut fur Normung e.V., Fire Behaviour of Building Materials and Elements, Overview and Design of Classified Building Materials, Elements and Components, DIN 4102-4, Mar. 1994, pp. 1-144.
DOW Corning Corporation, Dow Corning 790, Silicone Building Sealant, labeled Copyright 2000, pp. 1-6.
DOW Corning Corporation, Dow Corning 790, Silicone Building Sealant, Product Information, labeled Copyright 2000-2004, pp. 1-4.
DOW Corning Corporation, Dow Corning Firestop 400 Acrylic Sealant, 2001, pp. 1-4.
DOW Corning Corporation, Dow Corning Firestop 700 Silicone Sealant, 2001, pp. 1-6.
Emseal Joint Systems, Horizontal Colorseal, Aug. 2000, pp. 1-2.
Emseal Joint Systems, Ltd., Colorseal PC/SA Stick STD/001-0-00-00, 1995, p. 1.
Emseal Joint Systems, Ltd., 20H System, Tech Data, Jun. 1997, pp. 1-2.
Emseal Joint Systems, Ltd., Colorseal, Aug. 2000, pp. 1-2.
Emseal Joint Systems, Ltd., DSH System, Watertight Joint System for Decks, Tech Data, Nov. 2005, pp. 1-2.
Emseal Joint Systems, Ltd., Fire-Rating of Emseal 20H System, Feb. 17, 1993, p. 1-2.
Emseal Joint Systems, Ltd., Preformed Sealants and Expansion Joint Systems, May 2002, pp. 1-4.
Emseal Joint Systems, Ltd., Pre-Formed Sealants and Expansion Joints, Jan. 2002, pp. 1-4.
Emseal Joint Systems, Ltd., Seismic Colorseal, Aug. 2000, pp. 1-2.
Emseal Joint Systems, Ltd., Seismic Colorseal-DS (Double-Sided) Apr. 12, 2007, pp. 1-4.
Environmental Seals, Ltd., Envirograf, Fire Kills: Stop it today with fire stopping products for building gaps and openings, 2004, pp. 1-8.
Fire Retardants, Inc., Fire Barrier CP 25WB+Caulk, labeled Copyright 2002, pp. 1-4.
Illbruck Bau-Produkte GmbH u. CO. KG., willseal firestop, Product Information Joint Sealing Tape for the Fire Protection Joint, Sep. 30, 1995, pp. 1-9.
Illbruck, willseal, The Joint Sealing Tape, 1991, pp. 1-19.
Illbruck, willseal 600, Product Data Sheet, 2001, pp. 1-2.
Material Safety Data Sheet, Wilseal 150/250 and/or E.P.S., Jul. 21, 1986, pp. 1-2.
ISO 066, Technical Datasheet, blocostop F-120, 2002 p. 1.
MM Systems, ejp Expansion Joints, Expanding Impregnated Foam System, internet archive, wayback machine, Nov. 16, 2007, pp. 1-2.
MM Systems, ejp Expansion Joints, Colorjoint/SIF-Silicone Impregnated Foam System, Internet archive, wayback machine, Nov. 16, 2007, pp. 1-2.
MM Systems, ColorJoint/SIF Series, Silicone Seal & Impregnated Expanding Foam, Spec Data, 2007, pp. 1-3.
Norton Performance Plastics Corporation, Norseal V740FR, Flame Retardant, UL Recognized Multi-Purpose Foam Sealant, labeled Copyright 1996, pp. 1-2.
Promat International,Ltd., Promaseal FyreStrip, Seals for Movement Joints in Floors/Walls, labeled Copyright 2006, pp. 1-4.
Emseal Joint System, Ltd., Tech Data DSH System, Jan. 2000, pp. 1-2.
Emseal Joint Systems, Ltd., Emseal CAD.dwg, Oct. 2000, 7 pages.
Emseal Joint Systems, Ltd., Installation Instructions: AST & 1ST Sealant Tapes, Dec. 1998, p. 1.
Emseal Joint Systems, Ltd., Emshield WFR2, Fire-Rated Expansion Joint Product Data, Jun. 2009, pp. 1-2.
Emseal Joint System, Ltd., 1/2 Inch Colorseal, Binary Seal System Components, document dated Nov. 24, 1992, p. 1.
Iso-Chemie, ISO BLOCO 600 solukumitiiviste, Finnish language, pp. 1-2, Nov. 2013.
Iso-Chemie, ISO BLOCO 600, Produktbeskrivelse, Norwegian language, pp. 1-2, Nov. 2013.
Ashida, Polyurethane and Related Foams, Chapter three: Fundamentals, p. 43, pp. 1-3, Nov. 2013.
Merritt, Protection against Hazards, Section 3.30-3.31, 1994, pp. 1-4.
Schultz, Fire and Flammability Handbook, p. 363, 1985, pp. 1-3.
Netherlands Standards Institute, Fire resistance tests for non-loadbearing elements—Part 1: Walls, Aug. 1999, NEN-EN 1364-1, pp. 1-32.
Troitzsch, Jurgen, International plastics flammability handbook, 1983, pp. 1-2.
Polytite Manufacturing Company, Polytite "R" Colorized Joint Sealant, Jan. 7, 1998, pp. 1-2.
Quelfire, Passive Fire Protection Products, catalog, pp. 1-68, Nov. 2013.
Quelfire, Intufoam, pp. 1-4.
Saint-Gobain Performance Plastics, Norseal V740, labeled Copyright 2001, pp. 1-2.
Sandell Manufacturing Company, Inc., Polytite Sealant and Construction Gasket, p. 1, Nov. 2013.

(56) References Cited

OTHER PUBLICATIONS

Schul International Corporation, Hydrostop, Expansion Joint System, Jan. 17, 2001, pp. 1-2.
Illbruck, Sealtite-willseal, Plant Bodenwohr, pp. 1-17, Nov. 2013.
Schul International Co., LLC., Sealtite "B" Type II, Part of the S3 Sealant System, Jan. 5, 2006, pp. 1-2.
Sealtite-willseal Joint Sealants, Equivalency Chart for Joint Sealants, p. 1, Nov. 2013.
Schul International Co., LLC., Material Safety Data Sheet, Seismic Sealtite, Revised date Oct. 23, 2002, pp. 1-3.
Sealtite-Willseal, Installation Procedures for Seismic Sealtite/250C Joint Sealant, Mar. 4, 2001, p. 1.
Tremco Illbruck Ltd., Technical Data Sheet, Alfasil FR, Issue 2, pp. 1-2, Nov. 2013.
Product Data Sheet, Art. No. 4.22.01 Compriband MPA, pp. 1-2, Nov. 2013.
UL Online Certifications Directory, XHBN.Guidelnfo, Joint Systems, last updated Sep. 21, 2013, pp. 1-4.
UL 1715 Fire Test of Interior Finish Material, p. 1, Nov. 2013.
Williams Products, Inc., Williams Everlastic 1715 Fire Classified Closures Tech Data, Oct. 2005, p. 1.
Williams Products, Inc., Everlastic Fire Classifed Closures 1715, pp. 1-3, Nov. 2013.
Williams Products, Inc., Installation for partion closures, p. 1, Nov. 2013.
Will-Seal Construction Foams, Will-seal is Tested to Perform, p. 1, Nov. 2013.
Will-Seal Precompressed Foam Sealant, How Will-Seal Works, p. 1, Nov. 2013.
Illbruck, Will-Seal, Basis of Acceptance, 3.0 Construction Requirements, Precompressed Foam Sealants, Section 07915, pp. 1-8, Nov. 2013.
Emseal Joint Systems, Ltd., Emseal Colorseal Tech Data, Jul. 2009, p. 1-2.
Emseal Joint Systems, Ltd., Emseal Colorseal Tech Data, Mar. 2011, p. 1-2.
Emseal Joint Systems, Ltd., Emseal Horizontal Colorseal Tech Data, Aug. 2014, p. 1-2.
Emseal Joint Systems, Ltd., Emseal Seismic Colorseal Tech Data, Oct. 2009, pp. 1-2.
Emseal Joint Systems, Ltd., Emseal Seismic Colorseal Tech Data, Jun. 2010, pp. 1-2.
Emseal Joint Systems, Ltd., Emseal MST, Multi-Use Sealant Tape, Sep. 2008, pp. 1-2.
Emseal Joint Systems, Ltd., Emseal MST, Multi-Use Sealant Tape, Oct. 2013, pp. 1-2.
Emseal Joint Systems, Ltd., Emshield DFR2 System, Tech Data, Sep. 2014, pp. 1-4.
Emseal Joint Systems, Ltd., Emshield DFR2, last modified Sep. 19, 2014, pp. 1-4.
Emseal Joint Systems, Ltd., Emshield DFR3, last modified Sep. 4, 2014, pp. 1-5.
Emseal Joint Systems, Ltd., Emshield WFR2 and WFR3, last modified Sep. 3, 2014, pp. 1-5.
Emseal Joint Systems, Ltd., Colorseal-on-a-reel, last modified Nov. 10, 2014, pp. 1-3.
Emseal Joint Systems, Ltd., Colorseal, last modified Oct. 9, 2014, pp. 1-3.
Emseal GreyFlex Expanding Foam Sealant for Facades, p. 1, Nov. 2013.
Emseal Joint Systems, Ltd., QuietJoint, Tech Data, Nov. 2012, pp. 1-2.
Emseal Corporation Ltd., Material Safety Data Sheet, QuietJoint, MSDS Date May 13, 2014, pp. 1-2.
Emseal Joint Systems, Ltd., QuietJoint CAD Details, last modified Oct. 31, 2014, pp. 1-3.
http://www.emseal.com/products/architectural/QuietJoint/QuietJoint.htm, QuietJoint Mass-Loaded Acoustic Partition Closure, last modified Oct. 9, 2014, pp. 1-4.
http://www.emseal.com/products/architectural/QuietJoint/QuietJoint.htm, QuietJoint Mass-Loaded Acoustic Partition Closure, last modified Jul. 29, 2014, pp. 1-4.
http://www.emseal.com/products/architectural/QuietJoint/QuietJoint.htm, QuietJoint Mass-Loaded Acoustic Partition Closure, No intumescent coating, last modified Sep. 19, 2014, pp. 1-4.
http://williamsproducts.net/wide.html, Everlastic Wide Joint Seal, pp. 1-3, Nov. 2013.
Baerveldt, Konrad, The Applicator—Dear Tom: Emseal has two EIFS Expansion Joint Answers for you, Jun. 1991, pp. 1-4.
Snapshot of Office Action issued in USSN 90/013,428; printed in 2015, 14 pages.
Tremco Illbruck, Webbflex BI PU Foam, Fire Rated Expanding Polyurethane Foam, Sep. 11, 2006, pp. 1-2.
DIN 4102-1, Fire Behaviour of Building Materials and Elements, Part 1, May 1998, pp. 1-33.
DIN 4102-2, Fire Behaviour of Building Materials and Building Components, Part 2, Sep. 1977, pp. 1-11.
DIN 4102-15, Fire Behaviour of Building Materials and Elements, Part 15, May 1990, pp. 1-15.
DIN 18542, Impregnated Cellular Plastics Strips for Sealing External Joints, Jan. 1999, pp. 1-10.
ASTM International, Standard Test Method for Surface Burning Characteristics of Building Materials, Designation: E-84-04, Feb. 2004, pp. 1-19.
Illbruck Bau-Technik GmbH, Illbruck Illmod 600, Jan. 2002, pp. 1-2.
Illbruck Sealant Systems, Inc., Illbruck Willseal 600, 2001, pp. 1-2.
Iso-Chemie GmbH., Iso-Bloco 600, pp. 1-2, Nov. 2013.
Iso-Chemie GmbH., Iso-Flame Kombi F 120, pp. 1-2. Nov. 2013.
Schul International, Co., LLC., Seismic Sealtite II, Colorized, Precompressed Joint Sealant for Vertical Applications, Technical Data, 2006, pp. 1-2.
Underwriters Laboratories, Inc., Standard for Safety, Tests for Fire Resistance of Building Joint Systems, UL-2079, Fourth Edition, Dated Oct. 21, 2004, Revisions through and including Jun. 30, 2008, pp. 1-38.
MM Systems Corp., MM DSS Expansion Joint, Dual Seal Self-Expanding Seismic System, Feb. 18, 2008, pp. 1-2.
Order Granting Request for Ex Parte Reexamination for US Patent 8,739,495, Dec. 12, 2014, Control No. 90/013,395, pp. 1-19.
Emseal Joint Systems, Ltd., Fire-Rating of Emseal 20H System, Feb. 17, 1993, p. 1.
C:\WP\SLSMTG\20HDBJ.TBL Apr. 18, 1993, 20H-Description, Benefits, Justification, p. 1, Nov. 2013.
Order Granting Request for Ex Parte Reexamination for US Patent 8,813,449, Feb. 11, 2015, Control No. 90/013,428, pp. 1-19.
Lester Hensley, "Where's the Beef in Joint Sealants? Hybrids Hold the Key," Applicator, vol. 23, No. 2, Spring 2001, pp. 1-5.
Emseal Joint Systems, Ltd, Seismic Colorseal, Tech Data, Apr. 1998, pp. 1-2.
Schul International Co., LLC, Sealtite VP Premium Quality Precompressed Joint Sealant for Weather tight, Vapor Permeable, Vertical Applications, Technical Data, dated Oct. 28, 2005, pp. 1-2.
ISO-Chemie GmbH, Product Data Sheet, ISO-FLAME Kombi F 120, pp. 1-2, Nov. 2013.
Schul International Co., LLC, Seismic Sealtite II, Colorized, Precompressed Joint Sealant for Vertical Applications, Technical Data, dated Sep. 20, 2006, pp. 1-2.
Dow Corning Corporation, Dow Corning 790 Silicone Building Sealant, copyright date 1995, 1999, pp. 1-5.
Emseal Joint Systems, Ltd, Horizontal Colorseal, Tech Data, Nov. 2008, pp. 1-2.
Emseal Joint Systems, Ltd, Seismic Colorseal, Tech Data, Jul. 2009, pp. 1-2.
Emseal Joint Systems, Ltd, Horizontal Colorseal, Tech Data, Jul. 2009, pp. 1-2.
Emseal Joint Systems, Ltd, Horizontal Colorseal, Tech Data, Jun. 2010, pp. 1-2.
Schul International Co., LLC, Sealtite "B", Pre-compressed Joint Sealant, Premium Quality for Secondary Sealant Applications, Technical Data, dated Oct. 28, 2005, pp. 1-2.
ISO-Chemie GmbH, ISO-FLAME Kombi F 120, 2006, German, pp. 1-2.

(56) References Cited

OTHER PUBLICATIONS

ISO-Chemie GmbH, Order Confirmation Sheet, dated Apr. 26, 2007, pp. 1-3.
ISO-Flame Kombi F 120, Net Price List, Schul International Co., dated Jun. 27, 2006, pp. 1.
Tremco Illbruck Limited, Compriband Super FR, Fire Rated Acrylic Impregnated Foam Sealant Strip, Issue 3, dated Apr. 12, 2007, pp. 1-2.
Figure 1: The BS 476; Part 20 & EN 1363-1 time temperature curve, pp. 1, Nov. 2013.
Schul International Co., LLC, Sealtite, Premium Quality Pre-compressed Joint Sealant for Waterproof Vertical Applications, pp. 1, Nov. 2013.
Schul International Co., LLC, Sealtite 50N, Premium Quality Pre-compressed Joint Sealant For Horizontal Applications, dated Oct. 28, 2005, pp. 1-2.
Will-Seal, Signed, Sealed & Delivered, pp. 1, Nov. 2013.
Illbruck/USA, Will-Seal 150 Impregnanted Precompressed Expanding Foam Sealant Tape, Spec-Data Sheet, Joint Sealers, dated Nov. 1987, pp. 1-2.
Illbruck, Inc., Will-Seal 250 Impregnanted Precompressed Expanding Foam Sealant Tape, Spec-Data Sheet, Joint Sealers, dated Aug. 1989, pp. 1-2.
U.S. Department of Labor, Material Safety Data Sheet, Identity: Willseal 150/250 and/or E.P.S., date prepared Jul. 21, 1986, pp. 1-2.
Illbruck, TechSpec Division Facade & Roofing Solutions, ALFAS compriband, Mar. 2005, pp. 1-10.
Salamander Industrial Products, Inc., blocoband HF—interior sealant, pp. 1, Nov. 2013.
Dow Corning Corporation, Dow Corning 790 Silicone Building Sealant, copyright 2000-2005, pp. 1-2.
Grace Fireproofing Products. Monokote Z-146T. 2007, pp. 1-2.
Polyurethane Foam Field Joint Infill Systems, Sep. 23, 2007 (via Snagit), PIH, pp. 1-5.
International Search Report and Written Opinion for PCT/US2014/032212, Aug. 25, 2014, pp. 1-13.
Grunau Illertissen GmbH, Fir-A-Flex, Fire Protection for Linear Gaps in Walls and Ceilings, dated Aug. 1996, pp. 1-4.
UL Standard for Safety for Rests for Fire Resistance of Building Joint Systems, UL 2079, Underwriters Laboratories Inc. (UL); Fourth Edition; dated Oct. 21, 2004.
Emseal "Pre-cured-Caulk-and-Backerblock" Not New, Not Equal to Emseal's Colorseal, Jul. 19, 2012.
Emseal Drawing Part No. 010-0-00-00 dated Dec. 6, 2005.
Emseal Horizontal Colorseal Tech Data, dated Jun. 1997.
Emseal Joint Systems, Drawing SJS-100-CHT-N, Nov. 20, 2007.
Emseal Technical Bulletin, Benchmarks of Performance for High-Movement Acrylic-Impregnated, Precompressed, Foam Sealants when Considering Substitutions, Jul. 3, 2012.
Emseal, Colorseal & Seismic Colorseal, May 1997, Install Data Colorseal & Seismic Colorseal, p. 1-2, Nov. 2013.
Emseal, Colorseal, Jan. 2000, Colorseal TechData, p. 1-2, Nov. 2013.
Emseal, Is there a gap in your air barrier wall design?, Jul. 19, 2012.
Manfredi, L. "Thermal Degradation and Fire Resistance of Unsaturated Polyester, Modified Acrylic Resins and their Composites with Natural Fibres"; Science Direct, 2005.
Stein et al., "Chlorinated Paraffins as Effective Low Cost Flame Retardants for Polyethylene", Nov. 2013.
DIN 4102, Part 2, Fire Behaviour of Building Materials and Building Components, Sep. 1977.
Emseal Joint Systems, Ltd., Material Safety Data Sheet for AST-HI-ACRYLIC, pp. 1-2, Nov. 2013.
ISO-Chemie, GmbH., Iso-Bloco 600, pp. 1-2, Nov. 2013.
ISO-Chemie, GmbH., Iso-Flame Kombi F 120, pp. 1-2., 2006.
Underwriters Laboratories Inc., UL Standard for Safety for Fire Tests of Building Construction and Materials, UL 263, Thirteenth Edition, Apr. 4, 2003, pp. 1-40.
Attached Comment regarding previously submitted DE 102005054375 A1 and Machine English Translation thereof which may contain a machine translation error, and Verified English Translation submitted herewith as replacement; 2015; 1 page.
List of several Emseal pending patent applications and patents, and Examiners assigned thereto; Apr. 2015; 2 pages.
Notification of Transmittal of International Preliminary Report on Patentability in PCT/US14/32212; Mar. 13, 2015; 4 pages.
Snapshot of Office Actions issued in U.S. Appl. No. 13/729,500; printed in 2015; 35 pages.
Snapshot of Office Actions issued in U.S. Appl. No. 14/278,210; printed in 2015; 27 pages.
Snapshot of Office Actions issued in U.S. Appl. No. 12/635,062; printed in 2015; 88 pages.
Snapshot of Office Actions issued in U.S. Appl. No. 13/731,327; printed in 2015; 42 pages.
Snapshot of Office Action issued in U.S. Appl. No. 14/455,398; printed in 2015; 9 pages.
Snapshot of Office Actions issued in U.S. Appl. No. 13/652,021; printed in 2015; 34 pages.
Snapshot of Office Actions issued in U.S. Appl. No. 14/080,960; printed in 2015; 10 pages.
Snapshot of Office Actions issued in U.S. Appl. No. 14/084,930; printed in 2015; 7 pages.
Snapshot of Office Action issued in U.S. Appl. No. 14/229,463; printed in 2015; 20 pages.
Snapshot of Office Action issued in U.S. Appl. No. 14/455,403; printed in 2015; 12 pages.
Snapshot of Office Action issued in U.S. Appl. No. 14/211,694; printed in 2015; 6 pages.
Report on the Filing or Determination of an Action Regarding a Patent or Trademark, Filed Aug. 13, 2014 regarding US Patent 8,739,495, 1 pg.
Plastics Flammability Handbook, pp. 52, 59, and 60, 3 pages, Nov. 2013.
Defendants' Answer, Counterclaims, Affirmative Defenses, and Jury Demand, Doc. 11, Filed Oct. 3, 2014, 20 pages.
Defendants' Objection to Plaintiffs Partial Motion to Dismiss, Doc. 24, Filed Nov. 10, 2014, pp. 1-3.
Defendants' Objection to Plaintiffs Motion to Strike Defendants' Tenth Affirmative Defense, Doc. 25, Filed Nov. 12, 2014, pp. 1-3.
Defendants' Answer, Counterclaims, and Affirmative Defenses to Plaintiff's Consolidated Complaint, Doc. 38, Filed Dec. 9, 2014, pp. 1-48.
Defendants' Objection to Plaintiffs Partial Motion to Dismiss Count III of Defendants' Counterclaim, Doc. 50, Filed Jan. 16, 2015, pp. 1-15.
Defendants' Surreply to Plaintiffs Partial Motion to Dismiss Count II of Defendants' Counterclaims., Doc. 55, Filed Feb. 13, 2015, pp. 1-6.
Joint Claim Construction and Prehearing Statement, Doc. 56, Filed Mar. 3, 2015, pp. 1-9.
Lester Hensley, "Where's the Beef in Joint Sealants? Hybrids Hold the Key," AWCI's Construction Dimensions, Jan. 2006, 3 pgs.
IsoChemie, Iso-Bloco 600, Correspondence of Jun. 8, 2006, 13 pages.
Shul International Company, Invoice #18925 to P. J. Spillane, Sep. 14, 2007, 5 pages.
Illbruck Inc., Tested Physical Properties, 1994, 1 page.
Andrea Frangi, Zum Brandverhalten von Holzdecken aus Hohlkasten-elementen; Jun. 1999; 125 pages (English Translation).
Defendants' Joint First Amended Preliminary Invalidity Contentions received at MKG Mar. 17, 2015, 25 pgs. total.
Defendants' Joint First Amended Preliminary Invalidity Contentions received at MKG Mar. 17, 2015, Appendix A, 6 pgs.
Defendants' Joint First Amended Preliminary Invalidity Contentions received at MKG Mar. 17, 2015, Appendix B, 270 pgs.
Defendants' Joint First Amended Preliminary Invalidity Contentions received at MKG Mar. 17, 2015, Appendix B, 376 pgs.
Defendants' Joint First Amended Preliminary Invalidity Contentions received at MKG Mar. 17, 2015, Appendix C, 125 pgs.
Defendants' Joint First Amended Preliminary Invalidity Contentions received at MKG Mar. 17, 2015, Appendix D, 4 pgs.
IBMB, Test Report No. 3263/5362, Jul. 18, 2002, English Translation, 14 pgs.
IBMB, Test Report No. 3263/5362, Jul. 18, 2002, German, 13 pgs.

(56) References Cited

OTHER PUBLICATIONS

IBMB, Test Certificate No. 3002/2719, Mar. 22, 2000, English Translation, 14 pgs.
IBMB, Test Certificate No. P-3568/2560-MPA BS, Sep. 30, 2000, English Translation, 22 pgs.
IBMB, Test Certificate No. P-3568/2560-MPA BS, Sep. 30, 2000, German, 14 pgs.
IFT Rosenheim, Evidence of Performance Test Report 105 324691/e U, Apr. 19, 2006, 8 pgs.
Watson Bowman Acme, Wabo Seismic Parking Deck Exp. Joints, Sales Drawing, Feb. 6, 1988, 3 pgs.
Emseal Corp., Horizontal Colorseal Data Sheet, Jun. 1997, 3 pgs.
Emseal Corp., Horizontal Colorseal Beneath Coverplate Product Design Drawing, Oct. 2000, 1 pg.
Emseal Corp., 20H System Data Sheet, Sep. 1996, pp. 1-2.
Watson Bowman Acme, Product Catalog, Feb. 1993, pp. 1-8.
Emseal Joint Systems, Watertight by Design, Buyline 0339, Copyrighted 1996 and marked Jan. 1999, 8 pgs.
Dow Corning, Down Corning 790 Silicone Building Sealant Data Sheet, Copyrighted 1995, 1999, 8 pgs.
Emseal Joint Systems, Sealing Joints in the Building Envelope: Principles, Products & Practices, Copyright date of 1999, 39 pgs.
Emseal Joint Systems, Product Catalog, Copyright date of 1987, 16 pgs.
Emseal Joint Systems, 20H-Compression Seal Comparison, Apr. 12, 1994, 1 pg.
Emseal Joint Systems, Ltd., Emseal Joint Systems, Marketing Brochure, Jan. 1997, 8 pgs.
City of San Diego, CWP Guidelines, Feb. 1992, pp. 1-13.
www.stifirestop.com, Specified Technologies, Inc., Product Data Sheet, Series ES Elastomeric Sealant, Copyright 2004, pp. 1-4.
www.stifirestop.com, Specified Technologies, Inc., Product Data Sheet, Pensil PEN300 Silicone Sealant, Copyright 2004, pp. 1-4.
Snapshot of Office Action issued in U.S. Appl. No. 14/540,514; printed in 2015, 22 pages.
Snapshot of Office Action issued in USSN 90/013,395; printed in 2015, 27 pages.
Schul International Co., LLC., Firejoint 2FR-H, Fire Rated Expansion Joint 2 Hour Fire Rated, labeled Copyright 2012, pp. 1-2.
Willseal LLC, Product Data Sheet, Willseal FR-H, Horizontal 2 and 3 hour fire rated seal, labeled Copyright 2013, pp. 1-2.
Schul International Co., LLC., Firejoint 2FR-V, Fire Rated Expansion Joint-2 Hour Fire Rated, labeled Copyright 2012, pp. 1-2.
Willseal LLC, Product Data Sheet, Willseal FR-V, Vertical 2 and 3 hour fire rated seal, labeled Copyright 2013, pp. 1-2.
UL Online Certifications Directory, System No. FF-D-0082, XHBN. FF-D-0082 Joint Systems, Jul. 29, 2013, pp. 1-2.
UL Online Certifications Directory, System No. FF-D-1100, XHBN. FF-D-1100 Joint Systems, Sep. 24, 2012, pp. 1-2.
UL Online Certifications Directory, System No. WW-D-2013, XHBN.WW-D-2013 Joint Systems, May 27, 2004, pp. 1-2.
UL Online Certifications Directory, System No. FF-D-2008, XHBN. FF-D-2008 Joint Systems, Mar. 31, 2003, pp. 1-2.
UL Online Certifications Directory, System No. FF-D-1053, XHBN. FF-D-1053 Joint Systems, Nov. 28, 2007, pp. 1-2.
UL Online Certifications Directory, System No. WW-D-3005, Xhbn. WW-D-3005 Joint Systems, Nov. 15, 1999, pp. 1-2.
UL Online Certifications Directory, XHHW.R8196 Fill, Void or Cavity Materials, labeled Copyright 2014, pp. 1.
UL Online Certifications Directory, XHBN.FF-D-0075 Joint Systems, Apr. 30, 2010, pp. 1-2.
UL Online Certifications Directory, System No. FF-D-0075, XHBN. FF-D-0075 Joint Systems, Aug. 21, 2014, pp. 1-2.
UL Online Certifications Directory, XHBN.FF-D-0094 Joint Systems, Sep. 11, 2013, pp. 1-2.
UL Online Certifications Directory, XHBN.FF-D-1121 Joint Systems, Apr. 25, 2013, pp. 1-2.
UL Online Certifications Directory, System No. FF-D-2006, XHBN. FF-D-2006 Joint Systems, Jun. 28, 2002, pp. 1-3.
Underwriters Laboratories (UK) Ltd., Assessment Report, Project No. 12CA37234, Aug. 24, 2012, pp. 1-20.
Emseal Joint Systems, Ltd., 2 inch Quietjoint—concrete to concrete, Part Number: SHH_2_WW_CONC, Mar. 25, 2014, p. 1.
Emseal Joint Systems, Ltd., 2 inch Quietjoint—gypsum to gypsum, Part No. SHH_2_WW_GYP, Mar. 25, 2014, p. 1.
Emseal Joint Systems, Ltd., 2 inch Quietjoint at concrete wall to window, Part No. SHG_2_WW_CONC_TO_GLASS_INSIDE_CORNER, Mar. 25, 2014, p. 1.
Emseal Joint Systems, Ltd., 2 inch Quietjoint at Gypsum Wall to Window, Part No. SHG_2_WW_GL_INSIDE_CORNER_GYP, Mar. 25, 2014, p. 1.
Emseal Joint Systems, Ltd., 2 inch Quietjoint—Concrete to Concrete at Head of Wall, Part No. SHH_2_HW_CONC_INSIDE_CORNER, Mar. 25, 2014, p. 1.
Emseal Joint Systems, Ltd., 2 inch Quietjoint—Gypsum to Concrete at Head of Wall, Part No. SHH_HW_GYP_CONC_Inside_Corner, Mar. 25, 2014, p. 1.
Emseal Joint Systems, Ltd., 2 inch Quietjoint at Wall Partition to Window, Part No. SHG_2_WW_GL_Inside_Corner_Wall_Partition_Window, Mar. 25, 2014, p. 1.
Emseal Joint Systems, Ltd., Emshield DFR3 MSDS, last modified Sep. 3, 2014, p. 1.
https://www.google.com/search, seismic colorseal 5130176 "5,130,176", printed on Oct. 12, 2014, p. 1.
http://www.amazon.com, search for emseal 8,739,495, 1-16 of 624 results for emseal 8,739,495, printed on Oct. 13, 2014, pp. 1-5.
http://www.amazon.com/QuietJoint-Acoustic-Partition-Closure-2-sided, QuietJoint Acoustic Partition Closure for 3 inch (75mm) Joint, 10 foot (3m), printed on Sep. 29, 2014, pp. 1-3.
http://www.amazon.com/QuietJoint-Acoustic-Partition-Closure-3-sided, QuietJoint Acoustic Partition Closure for 5/8 inch (15 mm) Joint, 10 foot (3m), printed on Oct. 13, 2014, pp. 1-3.
Illbruck, Illmod 2d, Product Information, 2002, pp. 1-2.
Emseal Joint Systems, Ltd., Laminations as a Build Choice—The Anatomy of Quality in Pre-Compressed Foam Sealants, last modified Jul. 30, 2013, pp. 1-3.

* cited by examiner

EXPANSION JOINT SYSTEM

CROSS REFERENCE TO RELATED APPLICATION

This application claims the benefit of U.S. Provisional Patent Application No. 61/727,351, filed on Nov. 16, 2012, the contents of which are incorporated herein by reference in its entirety and the benefits of which are fully claimed herein.

TECHNICAL FIELD

The present invention relates generally to expansion joint systems configured for use in concrete and other building systems, bridges, and roadways and, more particularly, to expansion joints configured to accommodate thermal and/or seismic movements in such systems while also assisting in alleviating deterioration of structural features due to environmental effects.

BACKGROUND INFORMATION

Concrete structures and other building systems often incorporate joints that accommodate movements due to thermal and/or seismic conditions. These joint systems may be positioned to extend through both interior and exterior surfaces (e.g., walls, floors, and roofs) of a building or other structure.

In the case of an exterior joint in an exterior wall, roof, floor, and so forth, exposed to external environmental conditions, the expansion joint system should also resist the effects of the external environment conditions. In vertical joints, such conditions will likely be in the form of rain, snow, or ice that is driven by wind. In horizontal joints, the conditions will likely be in the form of rain, standing water, snow, ice, and in some circumstances all of these at the same time. Additionally, some horizontal systems may be subjected to pedestrian and/or vehicular traffic.

With particular regard to bridge expansion joints, a major cause of structural deterioration of piers, columns and beams on bridges is leaking and/or deterioration of joints. Water laced with de-icing salts and atmospheric contaminants directed through expansion joints can shed directly onto critical structural elements of the bridges. Potential corrosion and subsequent spalling may occur thereby necessitating expensive reconstruction of beams, piers, columns, wing walls, and so forth.

Moreover, expansion joint products do not fully consider the irregular nature of some expansion joints. It is common for an expansion joint to have several transition areas along the length thereof. These may be walls, parapets, columns, or other obstructions. As such, the expansion joint product follows the joint as it traverses these obstructions. In many products, this is a point of weakness, as the homogeneous nature of the product is interrupted. Methods of handling these transitions include stitching, gluing, and welding. In many situations, it is difficult or impossible to prefabricate these expansion joint transitions, as the exact details of the expansion joint and any transitions and/or dimensions may not be known at the time of manufacturing.

Additionally, in many products, the afore-referenced transitions present weak spots from both a water proofing aspect and a fire resistant aspect. Both expansion joints and fire resistive expansion joints typically address either water tightness aspects or the fire resistive nature, but not both. This has typically resulted in the installation of two systems for each expansion joint where both a fire rating and water resistance is required. In many cases, however, there simply is not sufficient room in the physical space occupied by the expansion joint to accommodate both a fire rated system and a waterproofing system.

Accordingly, there exists a need for improved expansion joint systems, which can not only accommodate thermal and/or seismic movements, but also assist in alleviating and/or preventing deterioration of structural features due to environmental factors. There is a further need for such expansion joint systems that can also address fire and water resistance in one system.

SUMMARY

Embodiments disclosed herein address the above needs, as well as others.

According to an aspect, an expansion joint system comprises: a core; and a layer of elastomer disposed on the core. The core and the layer of elastomer disposed thereon form an elongated section, wherein the elongated section is configured to be oriented vertically between substantially coplanar substrates. The expansion joint system further comprises a termination section located at one end of the elongated section and comprising a flared end forming an angle with the elongated section and configured to direct fluid and/or particles and/or solvents away from the expansion joint system.

According to another aspect, an expansion joint system comprises: a core; and a layer of an elastomer disposed on the core. The core and the layer of elastomer disposed thereon form an elongated section, the elongated section configured to be oriented horizontally between substantially coplanar substrates and having an end portion configured to angle around a corner, the end portion being vertically oriented. The expansion joint system further comprises a termination section located at the end portion configured to angle around the corner. The termination section comprises a flared end forming an angle with the vertically oriented end portion and configured to direct fluid and/or particles and/or solvent away from the expansion joint system.

According to a further aspect, a fire and water resistant expansion joint system comprises: a first substrate; and a second substrate arranged substantially coplanar with the first substrate; and an expansion joint system located in compression between the first substrate and the second substrate. The expansion joint system comprises: an open celled foam having a fire retardant material infused therein, wherein the ratio of fire retardant material infused in the open celled foam is in a range of about 3.5:1 to about 4:1 by weight; and a layer of an elastomer disposed on the open celled foam. The open celled foam and the layer of elastomer disposed thereon form an elongated section, the elongated section being configured to be oriented vertically between the first substrate and the second substrate. The expansion joint system further comprises a termination section located at one end of the elongated section and comprising a flared end forming an angle with the elongated section and configured to direct fluid and/or particles and/or solvent away from the expansion joint system.

According to another aspect, a fire and water resistant expansion joint system comprises: a first substrate; a second substrate arranged substantially coplanar with the first substrate; and an expansion joint system located in compression between the first substrate and the second substrate. The expansion joint system comprises: open celled foam having a fire retardant material infused therein, wherein the ratio of fire retardant material infused in the open celled foam is in a range of about 3.5:1 to about 4:1 by weight; and a layer of an elastomer disposed on the open celled foam. The open celled foam and the layer of elastomer disposed thereon form an elongated section, the elongated section configured to be oriented horizontally between the substantially coplanar first substrate and the second substrate, and having an end portion configured to angle around a corner, the end portion being vertically oriented. The expansion joint system further comprises a termination section located at the vertically oriented end portion configured to angle around the corner, the termination section comprising a flared end forming an angle with the vertically oriented end portion and configured to direct fluid and/or particles and/or solvent away from the expansion joint system.

According to a further aspect, a termination section comprises: a core; and a layer of elastomer disposed on the core; wherein the termination section is configured for an expansion joint system comprising an elongated section configured to be oriented vertically between substantially coplanar substrates. The termination section is configured to be located at one end of the elongated section and comprises a flared end configured to form an angle with the elongated section and direct fluid and/or particles and/or solvents away from the expansion joint system.

According to a further aspect, a termination section comprises: a core; and a layer of elastomer disposed on the core, wherein the termination section is configured for an expansion joint system comprising an elongated section configured to be oriented horizontally between substantially coplanar substrates and having an end portion configured to angle around a corner, the end portion being vertically oriented. The termination section is configured to be located at the end portion to angle around the corner and comprises a flared end configured to form an angle with the vertically oriented end portion and direct fluid and/or particles and/or solvents away from the expansion joint system.

According to a still further aspect, a kit comprises: a termination section configured to attach to an elongated section of an expansion joint system. The termination section comprises: a core; and a layer of elastomer disposed on the core, wherein the termination section comprises a flared end configured to form an angle with a portion of the elongated section, and direct fluid and/or particles and/or solvents away from the expansion joint system.

DETAILED DESCRIPTION

Embodiments of the invention provide a resilient water resistant and/or fire resistant expansion joint system able to accommodate thermal, seismic, and other movements while maintaining water resistance characteristics, as well as able to direct, e.g., fluid, and/or particles and/or solvents away from the structure employing the expansion joint system. Thus, embodiments are particularly effective in providing protection from deterioration to the expansion joint system and surrounding structures due to environmental effects, such as water, snow, ice, oil, solvents, contaminants, debris, and so forth.

Accordingly, embodiments are suited for use in concrete buildings and other structures including, but not limited to, parking garages, stadiums, tunnels, bridges, roadways, airport runways, waste water treatment systems and plants, potable water treatment systems and plants, and the like. Moreover, it is noted that embodiments are particularly suitable for use as bridge expansion joint systems (BEJS).

Embodiments of the expansion joint systems disclosed herein are described, for example, as being installed between concrete substrates. However, it is noted that the expansion joint systems may be installed between substrates or surfaces other than concrete. Materials for such substrates or surfaces include, but are not limited to, glass, asphalt, stone (granite, marble, etc.), metal, and so forth. Particular structures for the substrates include, but are not limited to, a first deck and a second deck of a bridge, parking garage, and so forth.

Figure 1A:
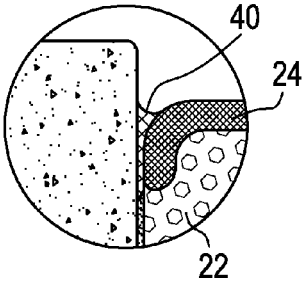
FIG. 1A is an enlarged view of a portion of FIG. 1.
Figure 1:
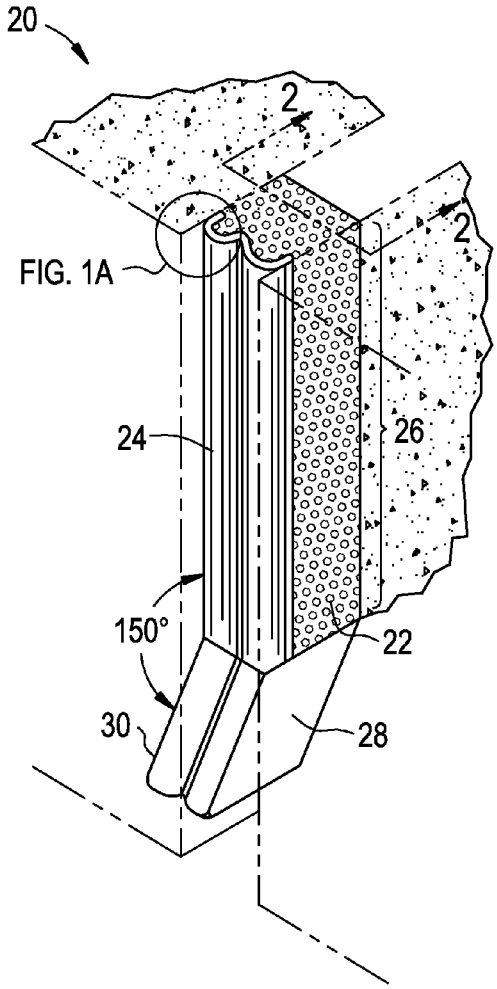
FIG. 1 is a perspective view of an expansion joint system comprising a vertically oriented elongated section.
Figure 2:
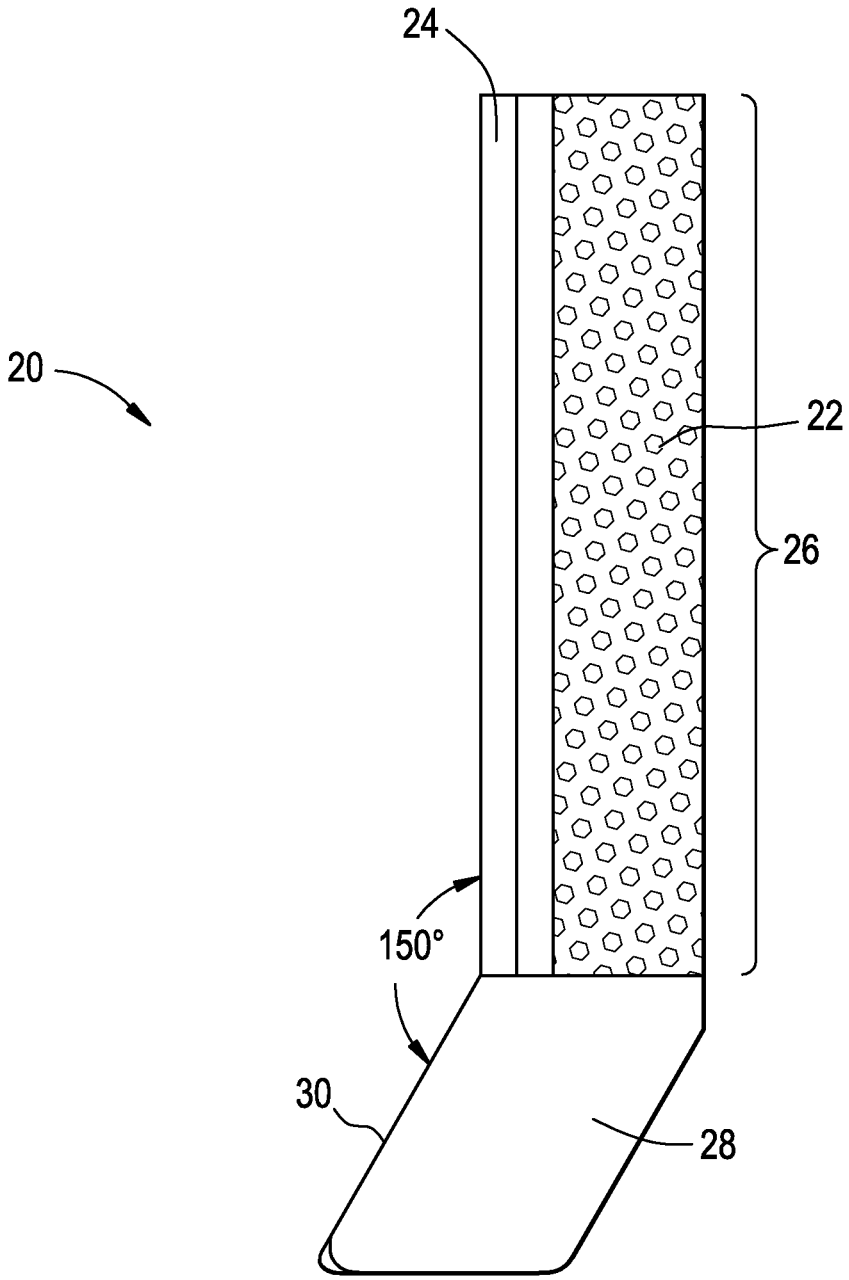
FIG. 2 is a side view of the expansion joint system of FIG. 1.

Referring now to FIGS. 1 and 2, shown therein according to an embodiment is an expansion joint system 20 oriented in a vertical plane. The expansion joint system 20 comprises: a core 22 and a layer of an elastomer 24 disposed on the core 22, wherein the layer of the elastomer 24 can be tooled to define a profile to facilitate compression by, for example, thermal and/or seismic expansion and contraction, of the expansion joint system 20 when installed between substantially coplanar substrates. The core 22 and the layer of elastomer 24 disposed thereon form an elongated section 26. As further shown in FIGS. 1 and 2, the elongated section 26 is configured to be oriented vertically between the substantially coplanar substrates in this non-limiting embodiment. A termination section 28 is located at one end of the elongated section 26 and comprises a flared end 30 forming an angle with the elongated section 26 and configured to direct, e.g., fluids and/or particles, and/or solvents, and so forth, away from the expansion joint system 20. Thus, the termination section 28 is angled, such that undesired substances, such as water, snow, ice, oil, fuel deposits, chemicals, such as chlorides, other contaminants, and so forth, which could detrimentally affect and/or deteriorate the expansion joint system 20 and surrounding structures advantageously can be directed away thereby protecting the expansion joint system 20 and/or surrounding structures from, e.g., cracking and erosion effects. Accordingly, the life span of the expansion joint system 20 and surrounding structures advantageously can be increased.

Figure 3:
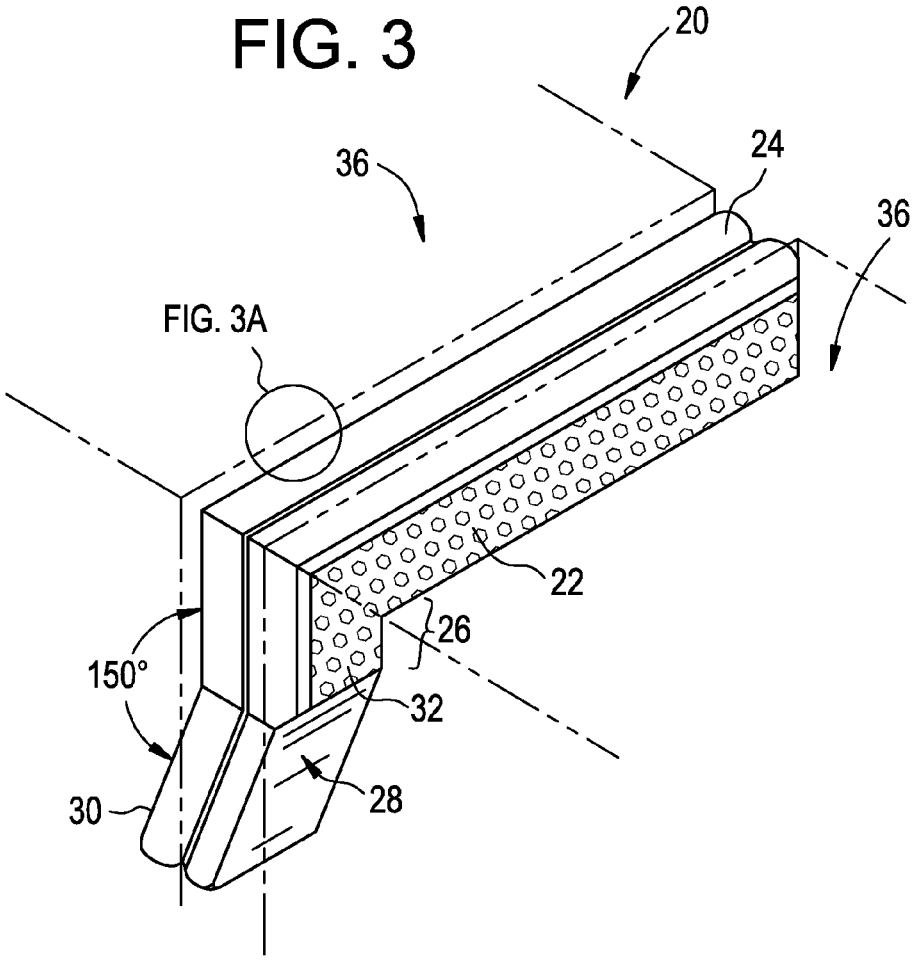
FIG. 3 is a perspective view of an expansion joint system comprising an horizontally elongated section and having an end portion configured to angle around a corner, and wherein the expansion joint system is located between two substantially coplanar substrates.
Figure 4:
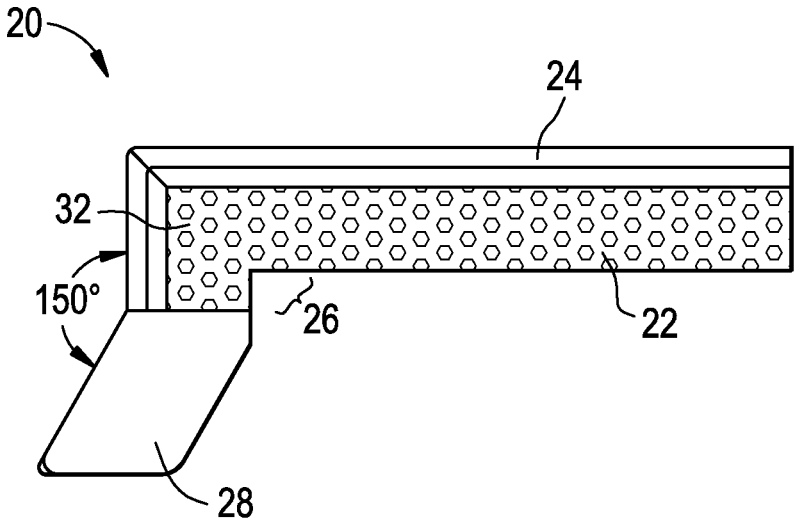
FIG. 4 is a side view of the expansion joint system of FIG. 3 (substantially coplanar substrates not shown)

It is noted that the elongated section 26 can be oriented in non-vertical orientations. The orientation depends on the particular need for the system 20, and the substrates employed. For instance, FIGS. 3-4 depict further non-limiting embodiments of system 20, wherein the elongated section 26 is configured to be oriented in a horizontal direction. More particularly, shown in FIGS. 3-4 is an expansion joint system 20, wherein the core 22 and the layer of elastomer 24 disposed thereon form an elongated section 26 configured to be oriented horizontally between the substantially coplanar substrates and having an end portion 32 configured to angle around a corner, the end portion 32 being vertically oriented. In this embodiment, termination section 28 is located at the end portion 32 configured to angle around the corner, and the termination section 28 comprises flared end 30 forming an angle with the vertically oriented end portion 32 and configured to direct fluid and/or particles and/or solvent away from the expansion joint system 20 and underlying structural features. Further details of system 20 are set forth below.

The expansion joint system 20 shown in each of FIGS. 1-5 comprises a section (e.g., one or more) of a core 22 of desired size and shape. Examples of materials for core 22 include, but are not limited to, foam, e.g., polyurethane foam and/or polyether foam, and the core 22 can be of an open celled or dense, closed cell construction. Core 22 is not limited to a foam construction, as core 22 can be made of any suitable material. Further examples of materials for core 22 include, paper based products, cardboard, metal, plastics, thermoplastics, dense closed cell foam including polyurethane and polyether closed cell foam, cross-linked foam, neoprene foam rubber, urethane, and/or composites. Combinations of any of the foregoing materials or other suitable materials for the core 22 can also be employed.

The core 22 can be infused with a suitable material including, but not limited to, waterproofing material such as an acrylic, such as a water-based acrylic chemistry, a wax, a fire retardant material, ultraviolet (UV) stabilizers, and/or polymeric materials, and so forth. A particularly suitable embodiment is a core 22 comprising an open celled foam infused with a water-based acrylic chemistry, and/or a fire retardant material.

One type of fire retardant material that may be used is a water-based aluminum tri-hydrate (also known as aluminum tri-hydroxide (ATH)). However, the present invention is not limited in this regard, as other fire retardant materials may be used. Such materials include, but are not limited to, metal oxides and other metal hydroxides, aluminum oxides, antimony oxides and hydroxides, iron compounds, such as ferrocene, molybdenum trioxide, nitrogen-based compounds, combinations of the foregoing materials, and other compounds capable of suppressing combustion and smoke formation.

Figure 5:
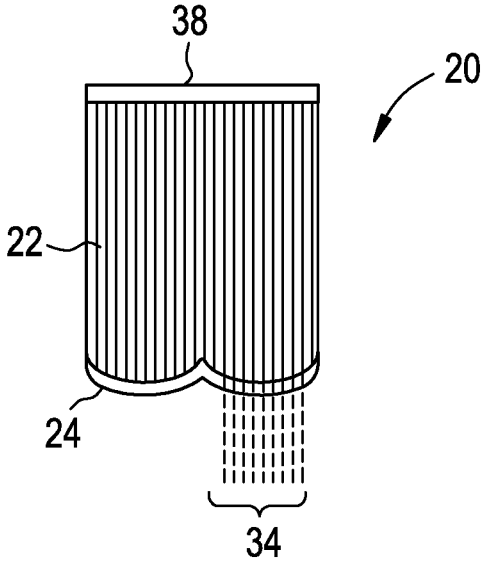
FIG. 5 is an end view of FIG. 1 taken along lines 2-2 of FIG. 1 (with addition of intumescent layer not shown in FIG. 1).

As is best seen in FIG. 5, the core 22 can comprise individual laminations 34 of the core material, e.g., foam, one or more of which can be infused with a suitable amount of the acrylic and/or fire retardant material and/or other desired material, such as wax, and so forth. For example, individual laminations 34 can extend substantially perpendicular to the direction in which the joint extends and are constructed by infusing each desired laminate with a suitable amount of, e.g, acrylic and/or fire retardant material. It should be noted that the present invention is not so limited as other manners of constructing the core 22 are also possible. For example, the core 22 is not limited to individual laminations 34 assembled to construct the laminate, as the core 22 may comprise a solid block of non-laminated foam or other suitable material of fixed size depending upon the desired joint size, a laminate comprising laminations oriented horizontally to adjacent laminations, or combinations of the foregoing, and so forth.

As a non-limiting example, the amount of fire retardant material infused into the core 22, such as an open celled foam, is between 3.5:1 and 4:1 by weight in a ratio with the uninfused core itself. The resultant uncompressed core whether comprising a solid block or laminates, has a density of about 130 kg/m$^3$ to about 150 kg/m$^3$, specifically 140 kg/m$^3$, according to embodiments.

The infused core 22, such as infused foam laminate, can be constructed in a manner which insures that substantially the same density of fire retardant is present in the product regardless of the final size of the product. For example, the starting density of the infused foam is approximately 140 kg/m$^3$, according to embodiments. After compression, the infused foam density is in the range of 200-700 kg/m$^3$. After installation, the laminate can cycle between densities of approximately 750 kg/m$^3$ at the smallest size of the expansion joint to approximately 400-450 kg/m$^3$ or less at the maximum size of the joint. This density of 400-450 kg/m$^3$ is based upon experiments as a reasonable minimum which still affords adequate fire retardant capacity, such that the resultant composite can pass the UL 2079 test program. The present invention is not limited to cycling in the foregoing ranges, however, as the material may attain densities outside of the herein described ranges. It is further noted that UL 2079, developed by Underwriters Laboratories, is a further refinement of ASTM E-119 by adding a cycling regimen to the test. Additionally, UL 2079 stipulates that the design be tested at a maximum joint size. This test is more reflective of real world conditions, and as such, architects and engineers have begun requesting expansion joint products that meet it. Many designs which pass ASTME-119 without the cycling regime do not pass UL 2079. This may be adequate for non-moving building joints; however, most building expansion joint systems are designed to accommodate some movements as a result of thermal effects (e.g., expansion into the joint and contraction away from the joint) or as a result of seismic movement. Advantageously, embodiments of the expansion joint system 20 disclosed herein meet and can pass UL 2079 testing.

As best seen in FIG. 3, the expansion joint system 20 is positionable between opposing substrates 36, which may comprise concrete, glass, wood, stone, metal, or the like, to accommodate the movement thereof. Non-limiting examples of structures for opposing substrates 36 include, a first deck and a second deck of a bridge, thereby forming a bridge expansion joint system (BEJS) construction, a first deck and a second deck of another structure such as parking garage, building, and so forth. As an example, opposing surfaces of the core 22 can be retained between the edges of the substrates 36. Compression of the core 22 during the installation thereof between the substrates 36 can enable the expansion system 20 to be held in place. Alternatively, or additionally, fasteners such as a screws, bands, adhesives, and so forth, could be used to assist in retaining the expansion system 20 in place.

In any embodiment, for example when individual laminations 34 are used, several laminations, the number depending on the expansion joint size (e.g., the width, which depends on the distance between opposing substrates 36 into which the expansion joint system 20 is to be installed), can be compiled and then compressed and held at such compression in a suitable fixture. The fixture, referred to as a coating fixture, is typically at a width slightly greater than that which the expansion joint will experience at the greatest possible movement thereof.

It is noted that in the fixture, the laminations 34 can be configured in any desired shape and size depending upon the desired application and end use location of resultant expansion joint system 20. For example, the laminations 34 thus can be configured and factory fabricated, with use of a fixture, as a substantially straight portion of the elongated section 26, shown in FIGS. 1-2, or as having an end portion 32 configured to angle around a corner at any desired angle, such as 90 degrees, as shown in FIGS. 3-4. Thus, the core 22, which can comprise individual laminations 34, according to embodiments, is constructed of any desirable shape depending upon the desired application. Moreover, it is noted that the termination section 28 can also comprise the core 22 and be factory fabricated as a one piece construction including the elongated section 26. It is noted that the material for the core 22 of the termination section 28 can be the same as or different than the material for the elongated section 26. Thus, descriptions herein regarding materials, infusion, coating, formation of profile into, e.g., a bellows construction, and so forth, for the core 22 and the elastomer 24 layer thereon of the elongated section 26 also apply to the termination section 28. Typically, the termination section 26 and the elongated section 26 will be factory fabricated as one piece. However, multiple piece constructions also are possible. For example, the termination section 28 can be fabricated separately and subsequently attached to the elongated section 26 on the job site using e.g, a kit, as further explained below.

According to embodiments, in the fixture, the assembled infused or un-infused core 22 is typically coated with a waterproof elastomer 24 on, for example, one or more surface. The elastomer 24 may comprise, for example, at least one polysulfide, silicone, acrylic, polyurethane, poly-epoxide, silyl-terminated polyether, combinations and formulations thereof, and so forth, with or with or without other elastomeric components, coatings, liquid sealant materials, and so forth. A particularly suitable elastomer 24 for coating, e.g., laminations 34 for applications where vehicular traffic is expected is PECORA 301 (available from Pecora Corporation, Harleysville, Pa.) or DOW 888 (available from Dow Corning Corporation, Midland, Mich.), both of which are traffic grade rated silicone pavement sealants. For vertical wall applications, an especially suitable elastomer 24 for coating the laminations 34 is DOW 790 (available from Dow Corning Corporation, Midland, Mich.), DOW 795 (also available from Dow Corning Corporation), or PECORA 890 (available from Pecora Corporation, Harleysville, Pa.). A primer may be used depending on the nature of the adhesive characteristics of the elastomer 24.

During or after application of the elastomer 24 to, e.g., laminations 34 of the termination section 28 and the elongated section 26, shown in FIGS. 1-4, the elastomer 24 can tooled or otherwise configured to create a "bellows," "bullet," or other suitable profile such that the expansion joint system 20 can be repeatedly compressed in, e.g., a uniform and aesthetic fashion while being maintained in a virtually tensionless environment. The profile can be of any suitable size and dimension. As a non-limiting example, widths less than about 1 inch have a convex single bellows surface. As a further non-limiting example, widths between about 1 inch and about 4 inches have a dual bellow surface, as shown in FIGS. 1 and 3.

It is noted that the layer of elastomer 24 located on the termination section 28 and the elongated section 26 can be the same or different. The layer of elastomer 24 also can be continuous or non-continuous over the elongated section 26 and termination section 28. It is further noted that while, e.g., FIG. 3 schematically depicts the layer of the elastomer 24 as having an essentially straight edge over the elongated section 26 and the vertically oriented end section 32, the transition of the elastomer layer 24 there over also can be in a smooth, more rounded fashion, which typically occurs upon application of the elastomer layer 24.

Additionally, typically the termination section 28 comprises the elastomer 24 on all external surfaces of the termination end, although this is not required. For example, an additional coating layer, such as an intumescent layer 38 further described below, could be located over the layer of elastomer 24 on one or more surfaces of the termination section 28, and/or located directly on one or more surfaces of the termination section 28.

As shown in the embodiments of FIGS. 1-2, the termination section 28 is located at one end of the elongated section 26 and comprises a flared end 30 forming an angle with the elongated section 26. Similarly, as shown in the embodiments of FIGS. 3-4, the termination section 28 is located at the vertically oriented end portion 32 of the elongated section 26 and comprises flared end 30 forming an angle with the end portion 32 of the elongated section 26. The angle shown in FIGS. 1-4 is about 150 degrees. However, other angles could be employed including, but not limited to, between about 130 degrees and about 160 degrees, including angles of about 140 and about 145 degrees, and so forth. The angle should be of a suitable degree such that fluid and/or particles and/or solvents could be directed away from the expansion joint system 20 and/or surrounding structures with use of the flared end 30 of the termination section 28. Moreover, the termination section 28 is made in any suitable size and shape. For example, the termination section 28 can be configured to have a square or rectangular shape. Typically, the termination section 28 will be shaped and sized to complement the elongated section 26, as shown in FIGS. 1-4.

According to embodiments, the surface of, e.g., the infused laminate opposite the surface coated with the waterproofing elastomer 24 could be coated with an optional intumescent material 38, as shown in FIG. 5. An example of an intumescent material 38 is a caulk or sealant having fire barrier properties. A caulk is generally a silicone, polyurethane, polysulfide, sylil-terminated-polyether, or polyurethane and acrylic sealing agent in latex or elastomeric base. Fire barrier properties are generally imparted to a caulk via the incorporation of one or more fire retardant agents. One particular example of the intumescent material 38 is 3M CP25WB+, which is a fire barrier caulk available from 3M of St. Paul, Minn. As in the case of the elastomer 24, the intumescent material 38 could be tooled or otherwise configured to create a desired profile, such as a "bellows" profile, to facilitate compression of the lamination, such as compression (e.g., repeated expansion and contraction by thermal, seismic or other movement) of an infused open-celled foam lamination.

It is noted that various combinations of elastomer 24 and intumescent material 38 can be employed, according to embodiments. For example, either or both of the elongated section 26 and termination end 28 can be coated with a first layer of elastomer 24 followed by a second layer of intumescent material 38. Also, the side of the elongated section 26 and termination section 28 shown opposite the layer of elastomer 24 in FIGS. 1-4 could also be coated with the elastomer 24 and/or intumescent material 38, and in any order. The location, positioning and order of layering of the elastomer 24 and/or intumescent material 38 can be tailored depending upon which benefits, e.g, water proofing/water resistance from the elastomer 24 and/or fire resistance from an intumescent 38 layer are desired at what location of the expansion joint system 20. Moreover, multiple layers of elastomer 24 and/or intumescent 38 also are possible, according to embodiments, and the layers can comprise the same or different compositions.

After tooling or otherwise configuring to have, e.g., a bellows-type profile, the coating of elastomer 24 and any intumescent material 38, if applicable, can be cured in place on the core 22 of the elongated section 26 and/or termination end 28 while the lamination is held at the prescribed compressed width, thereby effecting a secure bond to the, e.g., infused laminations 34. After curing, the entire composite can then be removed from the fixture, optionally compressed to less than the nominal size of the material and packaged for shipment. In the packaging operation, a hydraulic or mechanical press (or the like) can be employed to compress the material to, e.g., a size below the nominal size of the expansion joint at the job site. For example, the material can be held at that the desired size by using a heat shrinkable poly film. The present invention is not limited in this regard, however, as other devices (ties and so forth) may be used to hold the material to the desired size.

As noted above, such construction with the use of individual laminations 34 is not required as a solid block construction, and so forth, could be employed. Accordingly, the descriptions herein regarding fabrication with use of a coating fixture and application of elastomer 24 and/or intumescent 38 layers also can apply to such non-laminations constructions.

Referring to FIG. 3, which illustrates substantially coplanar substrates 36, it is noted that installation of the expansion joint system 20 of any of the described embodiments between the substrates 36, could be accomplished with use of any suitable attachment mechanisms, which can be mechanical and/or non-mechanical. For example, typically an adhesive, such as an expoxy is employed. As a non-limiting example, the epoxy or other adhesive can be applied to the desired surfaces of the expansion joint system 20 prior to removing the expansion joint system 20 from packaging restraints thereof. Once the packaging has been removed, the expansion joint system 20 can be inserted into the joint in the desired orientation. It is noted that the system 20 will typically begin to expand once the packaging has been removed. Once the expansion joint system 20 has expanded to suit the expansion joint, it can become locked in by, e.g., the combination of the core pressure and the adhesive.

It is further noted that the adhesive may be pre-applied to the core 22, such as pre-applied to the foam laminations thereof. In this case, for installation, the lamination can be removed from the packaging and simply inserted into the expansion joint where it is allowed to expand to meet the concrete or other substrate. Once this is completed, the adhesive in combination with the back pressure of the core 22 can hold the core 22 in position.

Figure 3A:
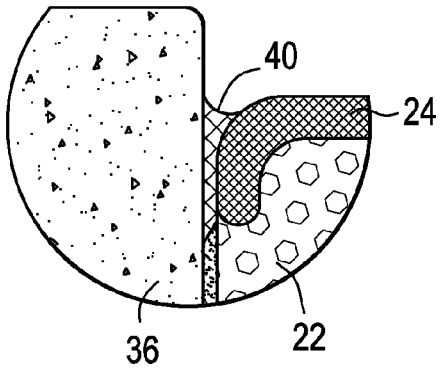
FIG. 3A is an enlarged view of a portion of FIG. 3.

Additionally, as best seen in FIGS. 1A and 3A, sealant band(s) and/or corner bead(s) 40 can be applied to the layer of elastomer 24 to help create, e.g., a water tight seal between the substrate 36 and the expansion joint system 20. The sealant band(s) and/or corner bead(s) can be made of any suitable material including, but not limited to, the material of elastomer 24 and/or intumescent 38. In FIGS. 1A and 3A, the depth of the corner bead 40 is shown as being ¾ inches. However, it will be appreciated that other depth/sizes can be employed depending upon, e.g., the application and size of the joint, structures, and so forth.

To fill an entire expansion joint, it is noted that the installation as described above could be repeated, if needed, using, e.g, the elongated section 26 without the termination section 28. For example, after inserting the system 20 as shown in FIG. 1-2 or 3-4, and adhering it securely to the substrate 36, a next section, such as a straight elongation section 28 without termination section 28 could be readied by placing it in proximity to the previously applied section. A band or bead 40 of elastomer 24 and/or intumescent 38 can be applied on the ends in desired locations. The next section could be allowed to begin to expand in close proximity to the previously installed section. When the expansion has taken place and the first installed section is beginning to adhere to the substrates 36, the next section can be firmly seated against the previously installed section. The outside faces could also be tooled to create an aesthetically pleasing seamless interface.

Additionally, regarding, e.g., bridge expansion joint system (BEJS) applications, the system 20, which also may be referred to as a "kick out termination" can be installed at the edge of a bridge deck(s) with its downturn over the side of the bridge and the termination section 28 or "drip edge" protruding out beyond the face of the slab. Thus, the "kick out termination" can be a factory fabricated piece, as described above, with a built in "drip edge" or termination section 28 that directs environmental effects, such as water runoff, and so forth, advantageously away from the bridge structure thereby assisting in increasing the life span of the BEJS and surrounding structures by preventing some deterioration of those surfaces from such adverse effects. For example, water that runs off of the joint is advantageously directed away from the bridge and its bearing pads, columns, and so forth, by, e.g., a silicone coated flared end 30 of the termination section 28. The "kick out termination" can be installed first, followed by connecting the afore-described straight length sections.

It is noted that in any embodiment, the construction or assembly of the systems 20 described herein is often carried out off-site, but elements thereof may be trimmed to appropriate length on-site. It is noted that such off-site assembly is not required. However, by constructing or assembling the systems 20 disclosed herein in a factory setting, on-site operations typically carried out by an installer, who may not have the appropriate tools or training for complex installation procedures, can be minimized. Accordingly, the opportunity for an installer to effect a modification such that the product does not perform as designed or such that a transition does not meet performance expectations also is minimized.

In furtherance to the above, it is noted that there may be instances where just the herein described termination section 28 is desired to be fitted onto an existing portion of an expansion joint system at, e.g., the job site. Such installation can be carried out with use of, e.g., a kit comprising the termination section 28 configured to attach to a section of an existing expansion joint system, such as attachment to elongated section 26 or even another portion/section depending upon the configuration of the system. This also can improve existing expansion joint systems in terms of, e.g., protecting the system and surrounding structures from deterioration due to exposure to environmental effects including fluid, and/or particles and/or solvents. During such an installment, the termination section 28 can be attached or secured using any suitable securing mechanism including, but not limited to adhesive, such as epoxy.

It is noted that the terms "a" and "an" and "the" herein do not denote a limitation of quantity, and are to be construed to cover both the singular and the plural, unless otherwise indicated herein or clearly contradicted by context. Any use of the suffix "(s)" herein is intended to include both the singular and the plural of the term that it modifies, thereby including one or more of that term. Reference throughout the specification to "one embodiment", "another embodiment", "an embodiment", and so forth, means that a particular element (e.g., feature, structure and/or characteristic) described in connection with the embodiment is included in at least one embodiment described herein, and may or may not be present in other embodiments. In addition, it is to be understood that the described elements may be combined in any suitable manner in the various embodiments. Moreover, regarding the Drawings, it is noted that the Drawings herein are merely representative of examples of embodiments and features thereof, and are thus not intended to be limiting or be of exact scale.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. An expansion joint system, comprising:

a core;

a layer of an elastomer disposed on the core, the core and the layer of elastomer disposed thereon forming an elongated section, the elongated section configured to be oriented vertically between substantially coplanar substrates; and a termination section located at one end of the elongated section and comprising a flared end forming an angle with the elongated section and configured to direct fluid and/or particles and/or solvents away from the expansion joint system.

2. The expansion joint system of claim 1, wherein the angle is about 150 degrees.

3. The expansion joint system of claim 1, wherein the termination section also comprises the core, and the elastomer which is layered on external surfaces of the termination section.

4. The expansion joint system of claim 1, wherein the layer of the elastomer is tooled to define a profile to facilitate compression of the expansion joint system when installed between the substantially coplanar substrates.

5. The expansion joint system of claim 1, wherein the elongated section and the termination section each comprise the layer of the elastomer in at least one of a bellows profile and a bullet profile.

6. The expansion joint system of claim 1, wherein the elongated section and the termination section are factory fabricated as a one piece unit.

7. The expansion joint system of claim 1, wherein the layer of elastomer is a continuous layer over the core of the elongated portion and the termination section.

8. The expansion joint system of claim 1, wherein elongated section and the termination section are fabricated separately, and the termination section is adhered to an end of the elongated section with an adhesive.

9. The expansion joint system of claim 1, wherein the termination section has a square or rectangular shape.

10. The expansion joint system of claim 1, wherein the core comprises open celled foam comprising a plurality of individual laminations assembled to construct a laminate, one or more of the laminations being infused with at least one of a fire retardant material and an acrylic.

11. The expansion joint system of claim 1, wherein the core comprises an open celled foam, and the open celled foam is infused with a fire retardant material selected from the group consisting of: aluminum tri-hydrate, a metal oxide, a metal hydroxide, aluminum oxide, antimony oxide, antimony hydroxide, an iron compound, ferrocene, molybdenum trioxide, a nitrogen based compound, and a combination thereof.

12. The expansion joint system of claim 11, wherein the fire retardant material is infused in the open celled foam in a ratio about 3.5:1 to about 4:1 by weight.

13. The expansion joint system of claim 1, wherein vertically oriented surfaces of the core are retained between edges of the coplanar substrates.

14. The expansion joint system of claim 1, wherein the core comprises at least one of open celled polyurethane foam and open celled polyether foam.

15. The expansion joint system of claim 1, wherein the elastomer disposed on the core comprises a silicone.

16. The expansion joint system of claim 1, wherein the elastomer disposed on the core is selected from the group consisting of polysulfides, acrylics, polyurethanes, poly-epoxides, silyl-terminated polyethers, and combinations of one or more of the foregoing.

17. An expansion joint system, comprising:

a core;

a layer of an elastomer disposed on the core, the core and the layer of elastomer disposed thereon forming an elongated section, the elongated section configured to be oriented horizontally between substantially coplanar substrates and having an end portion configured to angle around a corner, the end portion being vertically oriented; and a termination section located at the end portion configured to angle around the corner, the termination section comprising a flared end forming an angle with the vertically oriented end portion and configured to direct fluid and/or particles and/or solvent away from the expansion joint system.

18. The expansion joint system of claim 17, wherein the flared end of the termination section forms an angle of about 150 degrees with the vertically oriented end portion.

19. The expansion joint system of claim 17, wherein the termination section also comprises the core, and the elastomer which is layered on external surfaces of the termination section.

20. The expansion joint system of claim 17, wherein the system is factory fabricated as one piece.

21. The expansion joint system of claim 17, wherein the core comprises open celled foam comprising a plurality of individual laminations assembled to construct a laminate, one or more of the laminations being infused with at least one of a fire retardant material and an acrylic.

22. The expansion joint system of claim 17, wherein the core comprises open celled foam, and the open celled foam is infused with a fire retardant material selected from the group consisting of: aluminum tri-hydrate, a metal oxide, a metal hydroxide, aluminum oxide, antimony oxide, antimony hydroxide, an iron compound, ferrocene, molybdenum trioxide, a nitrogen based compound, and a combination thereof.

23. The expansion joint system of claim 22, wherein the fire retardant material is infused in the open celled foam in a ratio about 3.5:1 to about 4:1 by weight.

24. The expansion joint system of claim 17, wherein the core comprises at least one of a polyurethane open celled foam and a polyether open celled foam.

25. The expansion joint system of claim 17, wherein the elastomer disposed on the core comprises a silicone.

26. The expansion joint system of claim 1, wherein the system is a bridge expansion joint system.

27. The expansion joint system of claim 17, wherein the system is a bridge expansion joint system.

28. A fire and water resistant expansion joint system, comprising:

a first substrate;

a second substrate arranged substantially coplanar with the first substrate; and an expansion joint system located in compression between the first substrate and the second substrate, the expansion joint system comprising:

open celled foam having a fire retardant material infused therein, wherein the ratio of fire retardant material infused in the open celled foam is in a range of about 3.5:1 to about 4:1 by weight;

a layer of an elastomer disposed on the open celled foam, the open celled foam and the layer of elastomer disposed thereon forming an elongated section, the elongated section configured to be oriented vertically between the first substrate and the second substrate; and a termination section located at one end of the elongated section and comprising a flared end forming an angle with the elongated section and configured to direct water away from the expansion joint system.

29. The fire and water expansion joint system of claim 28, further comprising a layer of an intumescent material disposed on the open celled foam.

30. The fire and water expansion joint system of claim 28, wherein the termination section also comprises the open celled foam, and the elastomer which is layered on external surfaces of the termination section.

31. The fire and water expansion joint system of claim 28, wherein the elongated section and the termination section each comprise the layer of the elastomer tooled in at least one of a bellows profile and a bullet profile.

32. A fire and water resistant expansion joint system, comprising:

a first substrate;

a second substrate arranged substantially coplanar with the first substrate; and an expansion joint system located in compression between the first substrate and the second substrate, the expansion joint system comprising:

open celled foam having a fire retardant material infused therein, wherein the ratio of fire retardant material infused in the open celled foam is in a range of about 3.5:1 to about 4:1 by weight;

a layer of an elastomer disposed on the open celled foam, the open celled foam and the layer of elastomer disposed thereon forming an elongated section, the elongated section configured to be oriented horizontally between the substantially coplanar first substrate and the second substrate, and having an end portion configured to angle around a corner, the end portion being vertically oriented; and a termination section located at the vertically oriented end portion configured to angle around the corner, the termination section comprising a flared end forming an angle with the vertically oriented end portion and configured to direct water away from the expansion joint system.

33. A termination section comprising:

a core; and a layer of elastomer disposed on the core; wherein the termination section is configured for an expansion joint system comprising an elongated section configured to be oriented vertically between substantially coplanar substrates, wherein the termination section is configured to be located at one end of the elongated section and comprises a flared end configured to form an angle with the elongated section and direct fluid and/or particles and/or solvents away from the expansion joint system.

34. A termination section comprising:

a core; and a layer of elastomer disposed on the core, wherein the termination section is configured for an expansion joint system comprising an elongated section configured to be oriented horizontally between substantially coplanar substrates and having an end portion configured to angle around a corner, the end portion being vertically oriented, wherein the termination section is configured to be located at the end portion to angle around the corner and comprises a flared end configured to form an angle with the vertically oriented end portion and direct fluid and/or particles and/or solvents away from the expansion joint system.

35. A kit comprising a package and the termination section of claim 33.

36. A kit comprising a package and the termination section of claim 34.

37. A kit comprising:

a termination section configured to attach to an elongated section of an expansion joint system, the termination section comprising: a core; and a layer of elastomer disposed on the core, wherein the termination section comprises a flared end configured to form an angle with a portion of the elongated section, and direct fluid and/or particles and/or solvents away from the expansion joint system.

38. The kit of claim 37, further comprising an adhesive.

39. The kit of claim 35, wherein the expansion joint system is a bridge expansion joint system.

* * * * *